US007320956B2

(12) United States Patent
Johnson et al.

(10) Patent No.: US 7,320,956 B2
(45) **Date of Patent: *Jan. 22, 2008**

(54) AQUEOUS CLEANING/TREATMENT COMPOSITION FOR FIBROUS SUBSTRATES

(75) Inventors: Mitchell T. Johnson, Hudson, WI (US); Vinu Patel, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 429 days.

This patent is subject to a terminal disclaimer.

(21) Appl. No.: 10/815,277

(22) Filed: Apr. 1, 2004

(65) Prior Publication Data

US 2005/0227893 A1 Oct. 13, 2005

(51) Int. Cl.

| | |
|---|---|
| ***C11D 3/37*** | (2006.01) |
| ***C11D 17/00*** | (2006.01) |
| ***C11D 3/00*** | (2006.01) |
| ***B08B 3/14*** | (2006.01) |

(52) U.S. Cl. ..... 510/466; 8/137; 134/42; 510/406; 510/439; 510/528

(58) Field of Classification Search ..... 510/367, 510/400, 466, 439, 528, 406; 8/137; 134/42
See application file for complete search history.

(56) References Cited

U.S. PATENT DOCUMENTS

| | | | | |
|---|---|---|---|---|
| 1,901,536 | A | 3/1933 | Schafer | |
| 1,972,754 | A | 9/1934 | Biedermann | |
| 1,988,985 | A | 1/1935 | Schafer | |
| 2,112,361 | A | 3/1938 | Fischer | |
| 2,171,806 | A | 9/1939 | Russell et al. | |
| 2,723,999 | A | 11/1955 | Cowen et al. | |
| 2,915,554 | A | 12/1959 | Ahlbrecht et al. | |
| 3,433,780 | A * | 3/1969 | Cekada, Jr. et al. | 524/156 |
| 3,445,415 | A * | 5/1969 | Cekada, Jr. et al. | 524/832 |
| 3,493,424 | A | 2/1970 | Mohrlok et al. | |
| 3,787,351 | A | 1/1974 | Olson | |
| 4,351,736 | A | 9/1982 | Steinberger et al. | |
| 4,680,212 | A | 7/1987 | Blyth et al. | |
| 4,781,844 | A | 11/1988 | Kortmann et al. | |
| 4,833,009 | A | 5/1989 | Marshall | |
| 4,875,901 | A | 10/1989 | Payet et al. | |
| 4,883,839 | A | 11/1989 | Fitzgerald et al. | |
| 4,937,123 | A | 6/1990 | Chang et al. | |
| 4,940,757 | A | 7/1990 | Moss, III et al. | |
| 4,963,409 | A | 10/1990 | Liss et al. | |
| 5,001,004 | A | 3/1991 | Fitzgerald et al. | |
| 5,037,878 | A * | 8/1991 | Cerles et al. | 524/588 |
| 5,061,763 | A | 10/1991 | Moss, III et al. | |
| 5,073,442 | A | 12/1991 | Knowlton et al. | |
| 5,074,883 | A | 12/1991 | Wang | |
| 5,098,774 | A | 3/1992 | Chang | |
| 5,212,272 | A | 5/1993 | Sargent et al. | |
| 5,284,597 | A * | 2/1994 | Rees | 510/280 |
| 5,300,357 | A | 4/1994 | Gardiner | |
| 5,310,828 | A | 5/1994 | Williams | |
| 5,460,887 | A | 10/1995 | Pechhold | |
| 5,665,776 | A | 9/1997 | Yu et al. | |
| 5,728,669 | A | 3/1998 | Tyerech | |
| 6,187,738 | B1 | 2/2001 | Micciche et al. | |
| 6,468,587 | B2 | 10/2002 | Chang et al. | |
| 6,736,857 | B2 * | 5/2004 | Chang et al. | 8/115.51 |
| 6,802,870 | B2 * | 10/2004 | Chang et al. | 8/115.51 |
| 2003/0060395 | A1 * | 3/2003 | Chang et al. | 510/460 |
| 2003/0194447 | A1 | 10/2003 | Scholz et al. | |
| 2003/0211953 | A1 * | 11/2003 | Glenn et al. | 510/122 |
| 2004/0063600 | A1 * | 4/2004 | Williams et al. | 510/375 |

FOREIGN PATENT DOCUMENTS

| | | |
|---|---|---|
| WO | WO 92/07131 | 4/1992 |
| WO | WO 02/02862 | 1/2002 |

OTHER PUBLICATIONS

E. E. Gilbert, "Sulfonated and Related Reactions", Interscience Publishers, 1965.
A. Knopf et al., Phenolic Resins, Springer-Verlag, 1985.

* cited by examiner

*Primary Examiner*—Lorna M. Douyon
*Assistant Examiner*—Jaison Thomas
(74) *Attorney, Agent, or Firm*—Kent S. Kokko

(57) ABSTRACT

A cleaning and treating compositions for fibrous substrates, such as carpets is described. The compositions may be used to remove stains and impart anti-soiling and optionally stain release properties to the substrates.

33 Claims, No Drawings

AQUEOUS CLEANING/TREATMENT COMPOSITION FOR FIBROUS SUBSTRATES

FIELD OF THE INVENTION

This invention relates to cleaning and treating compositions for fibrous substrates, such as carpets. This invention also relates to a method for cleaning and treating fibrous substrates with these compositions to remove stains and impart anti-soiling and optionally stain release properties to the fibrous substrates.

BACKGROUND OF THE INVENTION

For many decades, carpet has been the floor covering of choice for improving both the aesthetics and comfort in residential homes and commercial buildings. Though very pleasing in appearance and convenience when new, the carpet over time inevitably is susceptible to staining by foods and beverages and also discoloration due to soil pick-up caused by foot traffic.

To minimize the effect of these assaults, various treatments have been applied to carpet either at the carpet mill or directly after installation ("early applied treatments"). Such early applied treatments include (a) fluoroaliphatic compounds and silsesquioxane polymers to provide soil resistance, (a1) fluoroaliphatic compounds that impart repellency to liquid spills and to prevent adherence to, and to facilitate release of, stains from fibers, (b) stainblockers to block dye sites to prevent acid-dye based stains from discoloring fibers, and (c) various combinations thereof. However, though these early applied treatments may impart good initial protection to carpet, the ability of the treated carpet fibers to resist both soiling and staining gradually diminishes over time due to foot abrasion and soil and stain buildup. At this point, the carpet must be cleaned to restore its initial appearance. Unfortunately, during cycles of carpet cleaning and use, factory treatments can become ineffective through contamination or may be removed from the carpet, leaving the carpet susceptible to accelerated discoloration from staining and soiling. Further, many conventional fabric and carpet treatment compositions are not effective at removing stains.

Despite these attempts, there continues to be a need an fibrous substrate cleaning composition that can simultaneously effectively clean the substrate, remove stains and provide long term anti-soiling and optionally stainblocking protection to the cleaned substrate.

SUMMARY OF THE INVENTION

In one aspect, this invention relates to an aqueous composition a silsesquioxane, to resist soiling, surfactant, to provide cleaning and a peroxy compound to remove stains. The composition may further comprise a stainblocking polymer, to render the substrate resisting to subsequent staining.

When used to clean fibrous substrates, the performance is equal to or better than levels of anti-soiling, stain removal and optional stainblocking performance provided by carpet manufacturers. Consumers have long since been aware that many cleaners leave behind sticky residues that can attract soil, thus giving the appearance that a spot has reappeared. Even when using surfactants and solvents, these cleaners can additionally remove the protection that was originally applied, thus leaving an area of the carpet that is much more susceptible to soiling from foot traffic and restaining from subsequent spills.

The levels of anti-soiling and optional stain-blocking imparted by this composition have only previously been accomplished through addition of fluorochemicals (FCs). Many previous patents have claimed oil repellency as a key benefit using an FC containing formulation, but in practice, oil repellency is not observed in any spot remover formulation on the market that contains an FC, although these products may impart various levels of antisoiling. The present invention uses a silsesquioxane as an antisoiling agent that is less expensive than the FCs and has superior antisoiling performance. This formulation develops antisoiling as soon as the treated fibrous substrate is dry, whereas other products may feel dry, but the surfactants and solvents stay greasy for quite some time afterward, increasing the likelihood of them re-soiling.

The optional stainblockers, as described herein impart excellent stainblocking properties to the treated fibrous substrate. These stainblockers also aid in stabilizing the peroxide and acting as a soil anti-re-deposition agent. Such agents help keep the soils suspended so that it can be removed by adsorption onto a cloth when still wet, or by complexing the soil and drying to a friable powder that is removed by vacuuming.

In another aspect, this invention relates to a method for cleaning a fibrous substrates and imparting superior soil and stain resistance properties to the substrate that includes (a) contacting the substrate with an aqueous composition of this invention, and (b) at least partial removal of the composition from the cleaned and treated substrate.

The cleaning and treating compositions of this invention may be used to effectively clean and treat soiled and stained fibrous substrates; remove stains, impart superior anti-soiling and optionally stainblocking properties to the cleaned fibrous substrates, such as carpets. This process can be employed with previously installed carpet or, alternatively, can be used in the carpet factory to clean and treat uninstalled, previously untreated carpet. Compositions of this invention can be utilized by carpet distributors and professional cleaners as well as by "do-it-yourself" consumers. The cleaning and treating compositions of this invention are shelf stable and can be stored at high concentration without separation.

The recitation of numerical ranges by endpoints includes all numbers and fractions subsumed within that range (e.g. 1 to 5 includes 1, 1.5, 2, 2.75, 3, 3.80, 4, and 5).

All numbers and fractions thereof are presumed to be modified by the term "about."

As used herein, "a" includes both the singular and plural.

The general definitions used herein have the following meanings within the scope of the present invention.

The term "alkyl" refers to, unless stated otherwise, straight or branched hydrocarbon radicals, such as methyl, ethyl, propyl, butyl, octyl, isopropyl, tert-butyl, sec-pentyl, and the like. Alkyl groups can either be unsubstituted or substituted with one or more substituents, e.g., halogen, alkoxy, aryl, arylalkyl, aralkoxy and the like. Alkyl groups include, for example, 1 to 25 carbon atoms, 1 to 8 carbon atoms, or 1 to 4 carbon atoms.

The term "halo" refers to, unless stated otherwise, fluoride, chloride, bromide, and iodide radicals.

The term "aryl" refers to, unless stated otherwise, monovalent unsaturated aromatic carbocyclic radicals having a single ring, such as phenyl, or multiple condensed rings, such as naphthyl or anthryl, which can be optionally substituted by substituents such as halogen, alkyl, arylalkyl, alkoxy, aralkoxy, and the like.

The term "alkoxy" refers to, unless stated otherwise, —O-alkyl with alkyl as defined above. Alkoxy groups include, for example, methoxy, ethoxy, propoxy, isopropoxy, and the like.

The term "alkaryl" refers to, unless stated otherwise, an alkyl radical defined as above bonded to an aryl radical as defined above (e.g. alkyl-aryl-).

The term "stainblockers" refers to agents that "block" dye sites on fibrous substrates. For example substrates like nylons (6, 6,6) and wool have amide groups—so-called dye sites. Dye sites are locations that bind dye molecules (acid dyes, food dyes, reactive dyes, metallized dyes); such dye sites having an affinity to these dye groups through forming covalent bonds, hydrogen bonds, or electrostatic interactions.

The term "antisoiler" or "antisoiling agents" are agent (molecular or polymeric, organic or inorganic) that resists or prevents dry soils from sticking to a substrate, in this case fibers. The dry soil is typically from dirt tracked in by foot traffic. The agent can be sacrificial—the dirt stick to the agent rather than the fiber and is removed by vacuuming, or the agent reduces the surface energy of the fibrous substrate, which prevents soils from sticking to fibers and allowing subsequent removal.

DETAILED DESCRIPTION OF THE INVENTION

This invention relates to new cleaning and treating compositions for fibrous substrates, such as carpet. This invention also relates to a method for cleaning and treating fibrous substrates with these compositions to remove stains and to impart anti-soiling and optionally stain release properties to the fibrous substrates. In particular, the present invention is directed to aqueous compositions that include a silsesquioxane, a peroxy compound, surfactant, optionally a stainblocking polymer, and a sequestering agent, or salt. While the present invention is not so limited, an appreciation of various aspects of the invention will be gained through a discussion of the examples provided below.

In one embodiment the aqueous composition may comprise:

(a) 0.25 to 5 preferably 0.5 to 2 most preferably 1 weight percent silsesquioxane;

(b) 1 to 8, preferably 2 to 4 most preferably 3 weight percent peroxy compound (c) 0.25 to 10 preferably 0.5 to 4 most preferably 1.25 weight percent surfactant, and (d) optionally 0 to 5, preferably 0.5 to 1.0 stainblocker weight percent stainblocker.

These silsesquioxane polymers are of the formula $R—SiO_{3/2}$ or $R—Si(OR')_3$ alone or together with silanes of the formula $Si(OR')_4$ and/or $R_2—Si(OR')_2$ wherein R represents a substituted or unsubstituted hydrocarbon radical having 1 to 7 carbon atoms, substituents of which may be halogen atoms and mercapto and epoxy groups. R' represents an alkyl radical with 1 to 4 carbon atoms. Preferred silsesquioxane polymers are those that are neutral or anionic. The silsesquioxane materials can be any of the types described in U.S. Pat. No. 4,781,844 (Kortmann, et al), U.S. Pat. No. 4,351,736 (Steinberger et al.), U.S. Pat. No. 5,073,442 (Knowlton et al.) or U.S. Pat. No. 3,493,424 (Mohrlok et al.) each of which are incorporated herein by reference, and in WO 2002/02862 (Chang et al.).

The silsesquioxane polymers may be prepared by adding silanes to a mixture of water, a buffer, a surface active agent and optionally an organic solvent, while agitating the mixture under acidic or basic conditions. It is preferable to add the quantity of silane uniformly and slowly in order to achieve a narrow particle size of 200 to 500 Angstroms. The exact amount of silane that can be added depends on the substituent R and whether an anionic or cationic surface active agent is used.

Silsesquioxane copolymers in which the units can be present in block or random distribution are formed by the simultaneous hydrolysis of the silanes. The preferred amount of silane of the formula $Si(OR')_4$ added is 2 to 50 percent, relative to the total weight of the silanes employed, preferably 3 to 20 percent.

The following silanes are useful in preparing the silsesquioxane polymers of the present invention: methyltrimethoxysilane, methyltriethoxysilane, methyltriisopropoxyoxysilane, ethyltrimethoxysilane, ethyltriethoxysilane, propyltrimethoxysilane, isobutyltrimethoxysilane, isobutyltriethoxysilane, 2-ethylbutyltriethoxysilane, tetraethoxysilane, and 2-ethylbutoxytriethoxysilane.

The compositions of the invention further include an oxidizing agent, which is preferably a peroxy compound or other agent that releases hydrogen peroxide in aqueous solution. As used in this specification, a peroxy compound is to be understood as to encompass hydrogen peroxide as well as any material or compound which in an aqueous composition yields hydrogen peroxide, or the conjugate base thereof. Examples of such materials and compounds include without limitation: alkali metal peroxides including sodium peroxide and potassium peroxide, alkyl peroxides such as t-butyl hydroperoxide, alkali perborate monohydrates, alkali metal perborate tetrahydrates, alkali metal persulfate, peroxy acid, esters and anhydrides, alkali metal percarbonates, alkali metal peroxyhydrate, alkali metal peroxydihydrates, and alkali metal carbonates especially where such alkali metals are sodium or potassium. Further useful are various peroxydihydrate, and organic peroxyhydrates such as urea peroxide.

Preferably the peroxy compound is selected from hydrogen peroxide, t-butyl peroxide, $R^3—C(O)OO—H$ (where $R^3$=alkyl or aryl, benzyl), $R^4—C(O)OOC(O)—R^4$ (wherein each $R^4$ is independently alkyl or aryl, benzyl), perborate or percarbonate salts Most preferably the peroxy compound is hydrogen peroxide. It is conventional in the art to use an industrial grade hydrogen peroxide in the formation of cleaning products. However, it has been found that the use of a higher purity hydrogen peroxide, such as hydrogen peroxide sold under the name Super D™, a product of EMC (USA), or Ultracosmetic™ grade provided by Solvay Interox Inc., (USA) provides the composition with an improved stability that justifies the higher initial costs of such peroxides.

The compositions of the present invention include from about 1 to about 8 percent by weight (wt. %), preferably from about 2 to about 4.0 wt. %, and most preferably from about 2.5 to about 3.5 wt. %, of a peroxy compound.

Surfactants are added to the composition to aid in the removal of soils and to stabilize the aqueous mixture. Useful classes of surfactants include nonionic, anionic, and amphoteric surfactants. The total amount of surfactant present in the composition generally is in the range from 0.25% to 10% by weight, preferably from 0.5% to %, by weight and more preferably from 1% to 3% by weight.

One useful class of hydrocarbon nonionic surfactants include the condensation products of a higher aliphatic alcohol, such as a fatty alcohol, containing about 8 to about 20 carbon atoms, in a straight or branched chain configuration, condensed with about 3 to about 100 moles, preferably about 5 to about 40 moles, most preferably about 5 to about 20 moles of ethylene oxide. Examples of such nonionic ethoxylated fatty alcohol surfactants are the Tergitol™ 15-S series from Union Carbide and Brij™ surfactants from ICI. Tergitol™ 15-S Surfactants include $C_{11}$-$C_{15}$ secondary alcohol polyethyleneglycol ethers. Brij™97 surfactant is Polyoxyethylene(10) oleyl ether; Brij™58 surfactant is polyoxyethylene(20) cetyl ether; and Brij™ 76 surfactant is polyoxyethylene(10) stearyl ether.

Another useful class of hydrocarbon nonionic surfactants include the polyethylene oxide condensates of one mole of alkyl phenol containing from about 6 to 12 carbon atoms in a straight or branched chain configuration, with about 3 to about 100 moles, preferably about 5 to about 40 moles, most preferably about 5 to about 20 moles of ethylene oxide to achieve the above defined HLB. Examples of nonreactive nonionic surfactants are the Igepal™ CO and CA series from Rhone-Poulenc. Igepal™CO surfactants include nonylphenoxy poly(ethyleneoxy)ethanols. Igepal™ CA surfactants include octylphenoxy poly(ethyleneoxy)ethanols.

Another useful class of hydrocarbon nonionic surfactants include block copolymers of ethylene oxide and propylene oxide or butylene oxide with HLB values of about 6 to about 19, preferably about 9 to about 18, and most preferably about 10 to about 16. Examples of such nonionic block copolymer surfactants are the Pluronic™ and Tetronic™series of surfactants from BASF. Pluronic™ surfactants include ethylene oxide-propylene oxide block copolymers. Tetronic™ surfactants include ethylene oxide-propylene oxide block copolymers.

Still other useful hydrocarbon nonionic surfactants include sorbitan fatty acid esters, polyoxyethylene sorbitan fatty acid esters and polyoxyethylene stearates having HLBs of about 6 to about 19, preferably about 9 to about 18, and most preferably about 10 to about 16. Examples of such fatty acid ester nonionic surfactants are the Span™, Tween™, and Myj™ surfactants from ICI. Span™ surfactants include $C_{12}$-$C_{18}$ sorbitan monoesters. Tween™ surfactants include poly(ethylene oxide) $C_{12}$-$C_{18}$ sorbitan monoesters. Myj™ surfactants include poly(ethylene oxide) stearates.

Particularly suitable hydrocarbon nonionic surfactants include polyoxyethylene alkyl ethers, polyoxyethylene alkyl-phenyl ethers, polyoxyethylene acyl esters, sorbitan fatty acid esters, polyoxyethylene alkylamines, polyoxyethylene alkylamides, polyoxyethylene lauryl ether, polyoxyethylene cetyl ether, polyoxyethylene stearyl ether, polyoxyethylene oleyl ether, polyoxyethylene octylphenyl ether, polyoxyethylene nonylphenyl ether, polyethylene glycol laurate, polyethylene glycol stearate, polyethylene glycol distearate, polyethylene glycol oleate, oxyethylene-oxypropylene block copolymer, sorbitan laurate, sorbitan stearate, sorbitan distearate, sorbitan oleate, sorbitan sesquioleate, sorbitan trioleate, polyoxyethylene sorbitan laurate, polyoxyethylene sorbitan stearate, polyoxyethylene sorbitan oleate, polyoxyethylene laurylamine, polyoxyethylene laurylamide, laurylamine acetate, hard beef tallow propylenediamine dioleate, ethoxylated tetramethyldecynediol, fluoroaliphatic polymeric ester, polyether-polysiloxane copolymer, and the like.

Preferably, the hydrocarbon surfactant corresponds to the following formula:

$$R_h^1—Y^1—W—Y^2—R_h^2, \quad \text{(I) wherein:}$$

W represents a polyoxyalkylene group, preferably a polyoxyethylene group; $Y^1$ and $Y^2$ independently represent an oxygen or sulfur atom or a group of the formula —CO—, —COO—, —NH—, —CONH—, or —N(R)—, where R is an alkyl group or an aryl group;

$R_h^1$ represents an alkyl or an aryl group, or a combination thereof, that may be substituted or unsubstituted and that contains from 2 to about 20 carbon atoms whose skeletal chain may be straight-chained, branched, or, if sufficiently large, cyclic, or any combination thereof, the skeletal chain can also optionally include one or more catenary heteroatoms (such as oxygen, hexavalent sulfur, and trivalent nitrogen atoms) bonded to the carbon atoms of the skeletal chain, and $R_h^2$ represents a hydrogen atom or is an alkyl or an aryl group, or a combination thereof, that may be substituted or unsubstituted and that contains from 2 to about 20 carbon atoms whose skeletal chain may be straight-chained, branched, or, if sufficiently large, cyclic, or any combination thereof, the skeletal chain can also optionally include one or more catenary heteroatoms such as oxygen, hexavalent sulfur, and trivalent nitrogen atoms bonded to the carbon atoms of the skeletal chain.

One or both of the depicted $R_h^1$ and $R_h^2$ may contain a polydialkylsiloxane group of the formula:

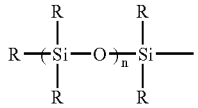

where all the depicted R groups are independently selected as alkyl or aryl groups having from 1 to about 10 carbon atoms that may be substituted or unsubstituted, straight-chained or branched, cyclic or acyclic, and may contain one or more catenary heteroatoms;

The variable W in the hydrocarbon surfactants according to the above formula I is a polyoxyalkylene group $(OR^1)s$, where $R^1$ is an alkylene group having from 2 to about 4 carbon atoms, such as $—CH_2CH_2—$, $—CH_2CH_2CH_2—$, $—CH(CH_3)CH_2—$, and $—CH(CH_3)CH(CH_3)—$, and s is a number such that the weight percent of oxyalkylene units in the hydrocarbon surfactant is between 20 and 80 percent and more preferably between 40 and 70 weight percent. The oxyalkylene units in the poly(oxyalkylene) group can be the same, such as in poly(oxypropylene) or poly(oxyethylene), or present as a mixture, such as in a hetero straight or branched chain of randomly distributed oxyethylene and oxypropylene units i.e., poly(oxyethylene-co-oxypropylene), or as in a straight or branched chain blocks of oxypropylene units.

Representative hydrocarbon surfactants according to Formula I above include ethoxylated alkylphenols (such as the TRITON™ TX, IGEPAL™ CA and IGEPAL™ CO series, commercially available from Union Carbide Corp. and Rhone-Poulenc Corp. respectively), ethoxylated dialkylphenols (such as the IGEPAL™ DM series, also commercially available from Rhone-Poulenc Corp.), ethoxylated fatty alcohols (such as the TERGITOL™ series, commercially available from Union Carbide Corp.) and polyoxyethylene fatty acid mono-esters and diesters (such as the MAPEG™ MO and MAPEG™ DO series, commercially available from PPG Industries, Inc.).

Another class of non-fluorinated, nonionic polyoxyethylene-containing surfactants in accordance with the invention may be described by the following formula:

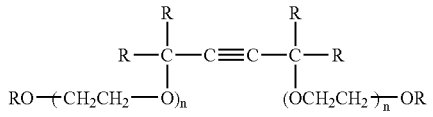

wherein: each n is independently a number between 2 and about 20 and are chosen such that the weight percent of polyoxyethylene in the surfactant is between 20 and 80 percent, preferably between 30 and 60 percent; and each R is selected independently from one another as an alkyl or an aryl group that may be substituted or unsubstituted and that contain from 2 to about 20 carbon atoms whose skeletal chain may be straight-chained, branched, or, if sufficiently large, cyclic, or any combination thereof; such skeletal chain can also optionally include one or more catenary heteroatoms such as oxygen, hexavalent sulfur, and trivalent nitrogen atoms bonded to the carbon atoms of the skeletal chain.

Another class of useful non-fluorinated, nonionic polyoxyethylene-containing surfactants useful in the practice of the invention include those organosiloxane compounds that may be represented generally by the following formula:

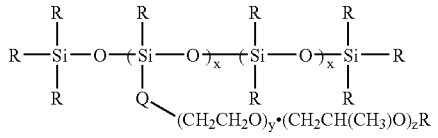

wherein: n, x, y, and z denote the number of repeating units in the depicted surfactant and are chosen such that the weight percent of polyethylene oxide in the surfactant is between 20 and 80 percent, preferably between 40 and 70 percent, and most preferably between 40 and 60 percent; It will be understood that the recurring siloxane units in the depicted formula may be randomly situated in the surfactant molecule;

Q is a mulfivalent, generally divalent, linking group, or is a covalent bond, that provides a means to link the silicon atom to the depicted oxyalkylene group; Q can comprise a heteroatom-containing group, e.g., a group containing —O—, —CO—, —$C_nH_{2n}O$—, or —$OC_nH_{2n}O$— where n is a number from 1 to 6; and each R is selected independently from one another as an alkyl, alkoxy, aryl or aryloxy group that may be substituted or unsubstituted and that contain from 1 to about 20 carbon atoms whose skeletal chain may be straight-chained, branched, or, if sufficiently large, cyclic, or any combination thereof, the skeletal chain can also optionally include one or more catenary heteroatoms such as oxygen, hexavalent sulfur, and trivalent nitrogen atoms bonded to the carbon atoms of the skeletal chain. Useful silicone surfactants of the type depicted by the formula include ethoxylated polydimethylsiloxanes, such as Silwet™ L-77, commercially available from Union Carbide Corp.

Useful fluorochemical surfactants include fluoroaliphatic group-containing nonionic compounds that contain one or more blocks of water-solubilizing polyoxyalkylene groups in their structures. A class of such surfactants is described in U.S. Pat. No. 5,300,357 (Gardiner), whose descriptions are incorporated herein by reference. Generally, the fluorochemical surfactants useful in the invention include those represented below by Formula II.

$$(R_f\text{-}Q)_n\text{-}Z \qquad \text{(II)}$$

wherein:

$R_f$ is a fluoroaliphatic group having at least 3, preferably at least 4, most preferably 4 to 7 fully-fluorinated carbon atoms that may be straight-chained, branched, or, if sufficiently large, cyclic, or any combination thereof. The skeletal chain in the fluoroaliphatic radical can include one or more catenary heteroatoms, such as oxygen, hexavalent sulfur, and trivalent nitrogen atoms bonded only to carbon atoms of the skeletal chain. Fully fluorinated fluoroaliphatic groups are preferred, but hydrogen or chlorine atoms may be present as substituents provided that not more than one atom of either if present for every two carbon atoms. While $R_f$ can contain a large number of carbon atoms, compounds where $R_f$ is not more than 20 carbon atoms will be adequate and preferred since larger radicals usually represent a less efficient utilization of the fluorine than is possible with shorter chains. Fluoroaliphatic radicals containing from about 4 to about 7 carbon atoms are most preferred. Generally, $R_f$ will contain between about 40 and about 78 weight percent fluorine. The terminal portion of the $R_f$ group preferably contains at least three fully fluorinated carbon atoms, e.g., $C_3F_7$—, and particularly preferred compounds are those in which the $R_f$ group is fully or substantially completely fluorinated, as in the case where $R_f$ is a perfluoroalkyl, e.g., $CF_3(CF_2)_n$—. Suitable $R_f$ groups include, for example, $C_4F_7$—, $C_6F_{13}CH_2CH_2$—, and $C_{10}F_{21}CH_2CH_2$—.

Q in Formula II above is a multivalent, generally divalent, linking group, or is a covalent bond, that provides a means to link $R_f$ with the depicted group Z, which is a nonionic, hydrophilic group; Q can comprise a heteroatom-containing group, e.g., a group such as —S—, —O—, —CO—, —$SO_2$—, —N(R)—, (where R is a hydrogen or a C, to $C_6$ substituted or unsubstituted alkyl group that may comprise a catenary heteroatom such as O, N, S), —$C_nH_{2n}$— (n=1 to 6); Q can comprise a combination of such groups such as would give, for example, —CON(R)$C_nH_{2n}$—, —$SO_2$N(R)$C_nH_{2n}$—, —$SO_3C_6H_4$N(R)$C_nH_{2n}$—, —$SO_2$N(R)$C_nH_{2n}$O[$CH_2CH(CH_2Cl)O]_gCH_2CH(CH_2Cl)$— (n=1 to 6; g=1 to 10), —$SO_2N(CH_3)C_2H_4OCH_2CH(OH)CH_2$—, —$SO_2N(C_2H_5)C_2H_4OCH_2CH(OH)CH_2$—, —$SO_2N(H)CH_2CH(OH)CH_2NHC(CH_3)CH_2$—, —$(CH_2)_2S(CH_2)_2$—, and —$(CH_2)_4CH(CH_3)$—;

Z in Formula II above is a nonionic, hydrophilic group comprising a poly(oxyalkylene) group, $(OR')_x$, where R' is an alkylene group having from 2 to about 4 carbon atoms, such as —$CH_2$ $CH_2$—, —$CH_2CH_2CH_2$—, —$CH(CH_3)CH_2$—, and —$CH(CH_3)CH(CH_3)$—, and x is a number between about 4 and about 25; Z preferably contains a poly(oxyethylene) group. The oxyalkylene units in said poly(oxyalkylene) being the same, such as in poly(oxypropylene), or present as a mixture, such as in a heteric straight or branched chain of randomly distributed oxyethylene and oxypropylene units i.e., poly(oxyethylene-co-oxypropylene), or as in a straight or branched chain blocks of oxypropylene units. The poly(oxyalkylene) chain can be interrupted by or include one or more catenary linkages such as where Z includes a group of the formula —O—$CH_2$—CH(O—)—$CH_2$—O—, providing such linkages do not substantially alter the water-solubilizing character of the poly(oxyalkylene) chain. The Z group may be terminated with a hydroxyl, alkyl ether (such as $C_1$ to $C_{20}$ alkyl ether), alkaryl ether, or fluoroalkyl ether, for example, —$OCH_3$, —$OCH_2CH_3$, —$OC_6H_4C(CH_3)_2CH_2C(CH_3)_2CH_3$, —$OC_6H_4(C_9H_{19})_2$, —$OC_{12}H_{25}$, —$OC_{14}H_{29}$, —$OC_{16}H_{33}$, or —O-$QR_f$ (where Q and $R_f$ are as defined supra); and n is a number from 1 to 6.

Specific examples of nonionic fluorochemical surfactants include:

$C_8F_{17}SO_2N(C_2H_5)CH_2CH_2(OCH_2CH_2)_7OCH_3$ $C_8F_{17}SO_2N(C_2H_5)CH_2CH_2(OCH_2CH_2)_9OCH_2CH_3$ $C_7F_{15}SO_2N(CH_3)CH_2CH_2(OCH_2CH_2)_7(OCH_2CH(CH_3))_4OH$ $C_8F_{17}SO_2N(C_2H_5)CH_2CH_2NHCH_2CH_2(OCH_2CH_2)_9NHC(O)—CH_3$ $F(CF_2CF_2)_nCH_2CH_2O(CH_2CH_2O)_xH$ wherein the last formula represents a mixture of compounds in which n is a number of about 2 to 6, and an average value of about 4, and x is about 14.

Fluoroaliphatic nonionic surfactants, including those depicted supra by Formula II, may be prepared using known methods including those methods described in U.S. Pat. No. 2,915,554 (Albrecht et al.). The Albrecht patent discloses the preparation of fluoroaliphatic group-containing nonionic compounds from active hydrogen-containing fluorochemical intermediates, such as fluoroaliphatic alcohols (e.g., $R_fC_2H_4OH$), acids (e.g., $R_fSO_2N(R)CH_2CO_2H$), and sulfonamides (e.g., $R_fSO_2N(R)H$) by reaction of the intermediates with, for example, ethylene oxide to yield, respectively, $R_fC_2H_4(OC_2H_4)_nOH$, $R_fSO_2N(R)CH_2CO_2(C_2H_4O)_nH$, and $R_fSO_2N(R)(C_2H_4O)_nH$, where n is a number greater than about 3 and R is a hydrogen or a lower alkyl group (e.g., from 1 to 6 carbon atoms). Analogous compounds may be prepared by treating the intermediate with propylene oxide. The fluoroaliphatic oligomers disclosed in U.S. Pat. No. 3,787,351 (Olson), and certain fluorinated alcohol-ethylene oxide condensates described in U.S. Pat. No. 2,723,999 (Cowen et al.), whose descriptions are incorporated herein by reference, are also considered useful. fluoroaliphatic group-containing nonionic surfactants containing hydrophobic long-chain hydrocarbon groups may be prepared by reacting a fluoroaliphatic epoxide, such as

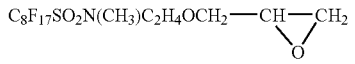

with, for example, an ethoxylated alkylphenol or alcohol, such as $CH_3C(CH_3)_2CH_2C(CH_3)_2C_6H_4(OC_2H_4)_9OH$ or $C_{12}H_{25}(OC_2H_4)_9OH$, respectively in the presence of $BF_3$-etherate. They may also be prepared by first converting the ethoxylated alkylphenol or alcohol to a chloride by reaction with thionyl chloride, then reacting the resulting chloride with a fluoroaliphatic sulfonamide containing an active hydrogen, for example $C_8F_{17}SO_2NH(CH_3)$, in the presence of sodium carbonate and potassium iodide.

Useful anionic surfactants include, but are not limited to, alkali metal and (alkyl)ammonium salts of: 1) alkyl sulfates and sulfonates such as sodium dodecyl sulfate, sodium 2-ethylhexyl sulfate, and potassium dodecanesulfonate; 2) sulfates of polyethoxylated derivatives of straight or branched chain aliphatic alcohols and carboxylic acids; 3) alkylbenzene or alkylnaphthalene sulfonates and sulfates such as sodium laurylbenzene-4-sulfonate and ethoxylated and polyethoxylated alkyl and aralkyl alcohol carboxylates; 5) glycinates such as alkyl sarcosinates and alkyl glycinates; 6) sulfosuccinates including dialkyl sulfosuccinates; 7) isothionate derivatives; 8) N-acyltaurine derivatives such as sodium N methyl-N-oleyltaurate); 9) amine oxides including alkyl and alkylamidoalkyldialkylamine oxides; and 10) alkyl phosphate mono or di-esters such as ethoxylated dodecyl alcohol phosphate ester, sodium salt.

Representative commercial examples of suitable anionic sulfonate surfactants include, for example, sodium lauryl sulfate, available as TEXAPON™ L-100 from Henkel Inc., Wilmington, Del., or as POLYSTEP™ B-3 from Stepan Chemical Co, Northfield, Ill.; sodium 25 lauryl ether sulfate, available as POLYSTEP™ B-12 from Stepan Chemical Co., Northfield, Ill.; ammonium lauryl sulfate, available as STANDAPOL™ A from Henkel Inc., Wilmington, Del.; and sodium dodecyl benzene sulfonate, available as SIPONATE™ DS-10 from Rhone-Poulenc, Inc., Cranberry, N.J., dialkyl sulfosuccinates, having the tradename AEROSOL™ OT, commercially available from Cytec Industries, West Paterson, N.J.; sodium methyl taurate (available under the trade designation NIKKOL™ CMT30 from Nikko Chemicals Co., Tokyo, Japan); secondary alkane sulfonates such as Hostapur™ SAS which is a Sodium (C14-C17) secondary alkane sulfonates (alpha-olefin sulfonates) available from Clariant Corp., Charlotte, N.C.; methyl-2-sulfoalkyl esters such as sodium methyl-2-sulfo(C12-16)ester and disodium 2-sulfo(C12-C16) fatty acid available from Stepan Company under the trade designation ALPHASTE™ PC48; alkylsulfoacetates and alkylsulfosuccinates available as sodium laurylsulfoacetate (under the trade designation LANTHANOL™ LAL) and disodiumlaurethsulfosuccinate (STEPANMILD™ SL3), both from Stepan Company; alkylsulfates such as ammoniumlauryl sulfate commercially available under the trade designation STEPANOL™ AM from Stepan Company.

Representative commercial examples of suitable anionic phosphate surfactants include a mixture of mono-, di- and tri-(alkyltetraglycolether)-o-phosphoric acid esters generally referred to as trilaureth-4-phosphate commercially available under the trade designation HOSTAPHAT™ 340KL from Clariant Corp., as well as PPG-5 cetyl 10 phosphate available under the trade designation CRODAPHOS™ SG from Croda Inc., Parsipanny, N.J.

Representative commercial examples of suitable anionic amine oxide surfactants those commercially available under the trade designations AMMONYX™ LO, LMDO, and CO, which are lauryldimethylamine oxide, laurylamidopropyldimethylamine oxide, and cetyl amine oxide, all from Stepan Company.

Examples of useful amphoteric surfactants include alkyldimethyl amine oxides, alkylcarboxamidoalkylenedimethyl amine oxides, aminopropionates, sulfobetaines, alkyl betaines, alkylamidobetaines, dihydroxyethyl glycinates, imidazoline acetates, imidazoline propionates, ammonium carboxylate and ammonium sulfonate amphoterics and imidazoline sulfonates.

Representative commercial examples amphoteric surfactants include certain betaines such as cocobetaine and cocamidopropyl betaine (commercially available under the trade designations MACKAM™ CB-35 and MACKAM™ L from McIntyre Group Ltd., University Park, Ill.); monoacetates such as sodium lauroamphoacetate; diacetates such as disodium lauroamphoacetate; amino- and alkylamino-propionates such as lauraminopropionic acid (commercially available under the trade designations MACKAM 1L, MACKAM™ 2L, and MACKAM™ 151L, respectively, from McIntyre Group Ltd.) and cocamidopropylhydroxysultaine (commercially available as MACKAM™ 50-SB from McIntyre Group Ltd.).

A wide variety of stainblocking polymers may be used in the compositions of this invention. Included among the useful stainblocking polymers are sulfonated aromatic polymers, polymers that are derived from at least one or more α- and/or β-substituted acrylic acid monomers, and hydrolyzed copolymers of at least one or more ethylenically unsaturated monomers and maleic anhydride. Also useful as stainblocking polymers are blends of at least two or more of these polymers, reaction products of at least two or more of the monomers from which these polymers may be derived, reaction products of at least one or more of the monomers from which the polymers may be derived and at least one or more of the polymers, and materials obtained by polymerizing at least one or more of the monomers in the presence of one or more of the polymers.

Sulfonated aromatic polymers are a preferred class of stainblocking polymers. Desirable examples may comprise a condensation polymer of an aldehyde (e.g., formaldehyde or acetaldehyde) and a sulfonated aromatic compound, or a subsequently sulfonated condensation polymer of an aldehyde and an aromatic compound. Various sulfonated aromatic compounds are available for use in the stainblocking compositions of the invention. However, among the most preferred materials are those which include hydroxyl functionality such as bis(hydroxy phenyl sulfone), hydroxy benzenesulfonic acid, hydroxynaphthalenesulfonic acid, sulfonated 4,4'-dihydroxydiphenylsulfone, and blends thereof. Other useful sulfonated aromatic polymers comprise a copolymer of an ethylenically unsaturated aromatic monomer (e.g., styrene) and a sulfonated ethylenically unsaturated aromatic monomer (e.g., styrene sulfonate).

Another preferred class of stainblocking polymers are polymers derived from at least one or more α- and/or β-substituted acrylic acid monomers. These monomers have the general structure $HR^1C{=}C(R)COOX$, wherein R and $R^1$ are independently selected from hydrogen, organic radicals and halogens, and X is independently selected from hydrogen, organic radicals and cations. Particularly preferred examples of the resulting polymers are acrylic polymers; i.e., polyacrylic acid, copolymers of acrylic acid and one or more other monomers that are copolymerizable with acrylic acid, and blends of polyacrylic acid and one or more acrylic acid copolymers. Even more preferred, however, are methacrylic polymers which includes polymethacrylic acid, copolymers of methacrylic acid and one or more other monomers that are copolymerizable with methacrylic acid, and blends of polymethacrylic acid and one or more methacrylic acid copolymers.

A third preferred class of stainblocking polymers includes hydrolyzed copolymers of at least one or more ethylenically unsaturated monomers and maleic anhydride. The ethylenically unsaturated monomers can be alpha-olefin type monomers (e.g. 1-alkenes), alkyl vinyl ethers or, more preferably, aromatic monomers such as styrene.

Quite useful stainblocking polymers may be obtained by blending together two or more polymers selected from among the different general classes of polymers described above, reacting together at least two or more monomers from which the different general classes of polymers are derived, reaction products of at least one or more of the monomers from which the polymers may be derived and at least one or more of the polymers, or by polymerizing at least one or more of the monomers in the presence of one or more of the polymers.

For example, one or more α- and/or β-substituted acrylic acid monomers may be polymerized together and, subsequent to the polymerization, blended with a sulfonated aromatic polymer. Alternatively, the α- and/or β-substituted acrylic acid monomers can be polymerized in the presence of a sulfonated aromatic polymer.

In another example, a hydrolyzed copolymer of ethylenically unsaturated monomer and maleic anhydride may be combined with a sulfonated aromatic polymer, and, optionally, a polymer derived from at least one or more α- and/or β-substituted acrylic acid monomers.

By "monomer" is meant a polymerizable single unit (typically of low molecular weight) that provides repeating units in the ultimate polymer, as well as partially reacted materials that can still participate in a polymerization reaction so as to provide repeating units in the ultimate polymer. The expression "at least" recognizes that monomers in addition to those mentioned may participate in the polymerization.

Sulfonated aromatic polymers useful in the invention may be obtained by condensation polymerizing an aldehyde with a sulfonated aromatic compound, the resulting polymer sometimes being referred to herein as either a sulfonated aromatic condensation polymer or as a condensation polymer. The resulting condensation polymer should contain a significant number of sulfonate groups. It is also preferred that the resulting condensation polymer be substantially soluble in water to simplify handling and application of the stainblocking composition to a substrate at normal temperatures (room temperature to 100° C., where "room temperature" refers to a temperature of 20 to 25° C.).

Any aldehyde that can be condensation polymerized with a sulfonated aromatic compound may be used in the invention. Suitable examples of such aldehydes include acetaldehyde, benzaldehyde, furfuraldehyde, and, most preferably, formaldehyde. Suitable sulfonated aromatic compounds for forming the condensation polymer include monomers such as benzene sulfonic acid (which, in general, may contain various combinations of alkyl, hydroxy and alkoxy substituents), toluene sulfonic acid, xylene sulfonic acid (e.g., 2,4-dimethyl benzene sulfonic acid), phenyl 4-sulfonic acid, cumene sulfonic acid, dodecylbenzene sulfonic acid, sulfonated diphenyl ether, benzaldehyde sulfonic acid, aminobenzene sulfonic acid, alkoxybenzenesulfonic acid, benzophenone sulfonic acid, sulfonated derivatives of styrene, dodecyl diphenyloxide disulfonic acid, sulfonated derivatives of naphthalene (e.g., naphthalene sulfonic acid), which derivatives may generally contain various combinations of alkyl, hydroxy and alkoxy substituents such as, alkylnaphthalene sulfonic acid (e.g., methylnaphthalene sulfonic acid) and alkoxynaphthalene sulfonic acid.

Including hydroxyl functionality in the sulfonated aromatic compound may enhance its solubility in water. Hydroxyl functionality may be introduced into the sulfonated aromatic compound (so as to form a sulfonated hydroxyaromatic compound) by either sulfonating a phenolic compound, or by polymerizing the aldehyde and the sulfonated aromatic compound with a hydroxyaromatic material (preferably a phenolic compound). Phenolic compounds useful in either approach include phenol, halogenated phenol (e.g., chlorophenol or trifluoromethylphenol), naphthol, dihydroxydiphenylsulfide, resorcinol, catechol, hydroxyarylcarboxylic acid (e.g., salicylic acid), hydroxyphenylphenyl ether, phenylphenol, alkylphenol (e.g., nonylphenol or cresol), dihydroxydiphenylsulfone, and bis(hydroxyphenyl)alkane (e.g., 2,2-bis(hydroxyphenyl)propane or 2,2,-bis(hydroxyphenyl)hexafluoropropane). Resulting materials include sulfoalkylated phenol, (e.g., sulfomethylated dihydroxydiphenyl sulfone). Particularly preferred sulfonated hydroxyaromatic compounds include bis(hydroxyphenyl)sulfone, hydroxybenzenesulfonic acid, hydroxynapthalenesulfonic acid, and sulfonated 4,4'-dihydroxydiphenylsulfone.

Enhanced solubility in water may also be obtained by providing the sulfonated aromatic compound as a salt based on, for example, sodium, potassium, or ammonium, such as sodium xylene sulfonate, ammonium xylene sulfonate, sodium toluene sulfonate, sodium cumene sulfonate, ammonium cumene sulfonate, potassium toluene sulfonate, potassium cumene sulfonate, and potassium xylene sulfonate.

Particularly preferred condensation polymers consist essentially of repeating units of the formula

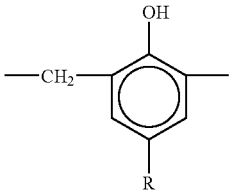

where R is the same or different in each unit, and is either hydrogen or a radical selected from the group consisting of —$SO_3X$,

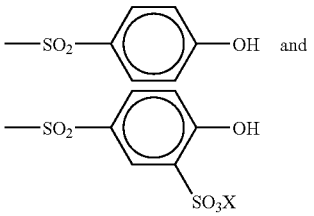

where X is hydrogen or a cation such as sodium or potassium, provided that the resulting polymer contains a sufficient number of sulfonate groups (typically at least 30%). Even more preferred are condensation polymers having these structures and which are water soluble, have at least 40% of the repeating units containing an —$SO_3X$ radial, and have at least 40% of the repeating units containing the group —$SO_2$—.

Sulfonated aromatic condensation polymers useful in the invention are described in U.S. Pat. No. 4,680,212 (Blyth et al.), U.S. Pat. No. 4,875,901 (Payet et al.), U.S. Pat. No. 4,940,757 (Moss, III et al.), U.S. Pat. No. 5,061,763 (Moss, III et al.), U.S. Pat. No. 5,074,883 (Wang), and U.S. Pat. No. 5,098,774 (Chang).

Sulfonated aromatic condensation polymers useful in the invention can be prepared by methods known to those skilled in the art. Sulfonation of phenolic compounds is described in, for example, *Sulfonated and Related Reactions*, E. E. Gilbert, Interscience Publishers, 1965. Methods of preparing condensation polymers of sulfonated aromatic compounds with formaldehyde are described in U.S. Pat. No. 1,901,536 (Schafer), U.S. Pat. No. 1,972,754 (Biedernann), U.S. Pat. No. 1,988,985 (Schafer), U.S. Pat. No. 2,112,361 (Fischer), U.S. Pat. No. 2,171,806 (Russell, et al.), U.S. Pat. No. 4,680,212 (Blyth et al.), U.S. Pat. No. 4,940,757 (Moss, III et al.), U.S. Pat. No. 5,061,763 (Moss, III et al.), and Phenolic Resins, A. Knopf et al., Springer-Verlag, 1985.

In general, an aromatic compound such as phenol, naphthalene or naphthol is sulfonated, for example by reacting it with a sulfonating compound such as sulfuric acid, chlorosulfonic acid or alkaline sulfite so as to form a sulfonated aromatic compound. The sulfonated aromatic compound is then condensation polymerized with formaldehyde or other aldehyde, typically under acidic conditions. Mixtures of different sulfonated aromatic compounds can also be polymerized. Typically, one mole of sulfonated aromatic compound is reacted with 0.5 to 1.2 mole of aldehyde. The sulfonated aromatic condensation polymer can be subsequently reacted with a base (e.g., sodium hydroxide, potassium hydroxide, or ammonium hydroxide) so as to form a sulfonic acid salt. Currently marketed condensation polymers are typically sold as a sodium sulfonate salt.

Alternatively, a sulfonated aromatic condensation polymer may be prepared by reacting an unsulfonated hydroxy aromatic compound (e.g., a phenolic compound such as phenol, naphthol, etc.) with an aldehyde such as formaldehyde and then sulfonating the resulting condensation polymer by treatment with fuming sulfuric acid.

Examples of useful, commercially available sulfonated aromatic condensation polymers include Erional™ NW (Ciba-Geigy Limited; containing a naphthalene sulfonic acid polymer with formaldehyde and 4,4'-dihydroxydiphenylsulfone), Erional™ PA (polymer of phenol sulfonic acid, formaldehyde, and 4,4' dihydroxydiphenyl sulfone from Ciba-Geigy), 3M™ brand stain release concentrate FX-369™ (3M Co.), Tamol™ SN (Rohm & Haas Co.), Mesitol™ NBS, Bayprotect CL or CSD™ (Bayer AG), Nylofixan™ P (containing a formaldehyde condensation copolymer of 4,4'-dihydroxydiphenylsulfone and 2,4-dimethylbenzenesulfonic acid, manufactured by Sandoz Corp.), and Intratex™ N (Crompton & Knowles Corp.). The sulfonated aromatic polymers are typically purchased commercially as a 30 to 40% solids aqueous solution that can contain other compounds, including aromatic sulfonic acids and glycols.

The effectiveness of a sulfonated aromatic condensation polymer in imparting stain resistance to a substrate may be improved by providing the condensation polymer in the form of a divalent metal salt. These salts are water soluble and are substantially free of sulfonic acid moieties (i.e., —$SO_3H$ groups); that is, they typically contain less than 1 mole percent sulfonic acid moieties. The salt form of the polymer may be obtained by reacting the condensation polymer with a divalent metal oxide or hydroxide, or the divalent metal salt of a weak acid (e.g., carbonic acid, boric acid, or a carboxylic acid) so as to form an aqueous solution having a pH of at least 3. In another approach, a sulfonated aromatic compound that is used to prepare the condensation polymer may first be converted to a salt (by using a divalent metal oxide or hydroxide, or a divalent metal salt of a weak acid) before reaction with an aldehyde to yield the salt form of the polymer. Suitable divalent metal oxides or hydroxides include oxides and hydroxides of calcium, magnesium and zinc. Divalent metal salts of weak acids include carbonates, bicarbonates, acetates, formates and borates of calcium, magnesium and zinc. Even further improvements in stain resistance may be achieved by adding small amounts (less than 0.1% SOF, more preferably less than 0.05% SOF) of a divalent metal salt (such as those discussed in the additives section below) to the salt form of the polymer. (% SOF refers to the % solids based on the weight of the fibrous substrate.) Such techniques are described in U.S. Pat. No. 5,098,774 (Chang).

Sulfonated aromatic condensation polymers may discolor with time and assume a yellow tint that can be undesirable, especially depending on the color of the substrate to which the stainblocking composition is applied. Thus, a blue substrate may acquire a greenish cast. One technique for reducing the tendency to change color is to remove color formers inherent in the stainblocking polymer. This can be accomplished by dissolving the condensation polymer in aqueous base so as to form a solution having a pH of 8-12, acidifying the aqueous solution to a pH of a 2 to 7.5, heating the acidified material to a temperature of 50 to 65° C. so as to cause phase separation, removing materials which remain water-soluble after acidification and heating (e.g., by filtering, centrifuging or decanting), and dissolving the resultant water-insoluble material in aqueous base to a final pH of at least 8, using heat as necessary to effect dissolution. Strong bases (e.g., sodium hydroxide, potassium hydroxide, lithium hydroxide) may be used. Virtually any acid is suitable, e.g. glacial acetic acid, dilute acetic acid, hydrochloric acid, sulfuric acid, oxalic acid, citric acid, or sulfamic acid. Such techniques are described in U.S. Pat. No. 4,833,009 (Marshall).

Another technique for reducing the tendency to change color is to acylate or etherify a portion of the free hydroxyl groups in the condensation polymer. However, acylating or etherifying the free hydroxyl groups can reduce the stainblocking characteristics of the condensation polymer. Thus, the portion of the free hydroxyl groups that are so treated should strike a balance between a reduced tendency to yellow and effective stainblocking. Useful acylating agents include acetic anhydride and ethylchloroformate (conversion of 50% to 80% of the phenolic hydroxyl groups). Chloroacetic acid is a useful etherifying agent (conversion of 40% to 60% of the phenolic hydroxyl groups). The acylated and etherified products can be prepared by dissolving the condensation polymer in an aqueous medium having a pH of 7 or above, preferably 10 or 11 to 13 or 14 (the actual pH depending on the acylating or etherifying agent), and at a temperature that favors acylation or etherification. The water-insoluble phase can be separated from the unwanted water solution by filtering, centrifuging, decanting, etc., and then redissolved in a hydroxyl-functional material, such as ethylene glycol, 1,3-propylene glycol, or 1,3-butylene glycol. Such techniques are described in U.S. Pat. No. 4,963,409 (Liss et al.).

In another embodiment, sulfonated aromatic polymers useful in the invention as stainblocking polymers may comprise a copolymer of: (a) one or more ethylenically unsaturated aromatic monomers; and (b) one or more sulfonated ethylenically unsaturated aromatic monomers. Specific examples of ethylenically unsaturated aromatic monomers (a) include styrene, a-methylstyrene, 4-methyl styrene, stilbene, 4-acetoxystilbene, eugenol, isoeugenol, 4-allylphenol, safrole, and mixtures of these materials. Preferably, the sulfonated monomers are water soluble, which can be facilitated by providing the monomer in the form of a salt, for example, salts of alkali metals (e.g., sodium) and ammonium salts. A variety of sulfonated monomers (b) may be used including those which result from sulfonating the ortho and/or para positions of the monomers used to provide ethylenically unsaturated aromatic monomer (a). Particular examples include sodium p-styrene sulfonate, sodium vinyl p-toluene sulfonate, ammonium p-styrene sulfonate.

In the sulfonated aromatic copolymers of this embodiment, the ratio of units derived from monomer (a) to the units derived from monomer (b) is preferably 0.1 to 10:1, more preferably 0.9:1. Materials of this type are described in International Patent Publication No. WO 92/07131 (E. I. du Pont de Nemours and Company). The sulfonated aromatic copolymers can be conveniently prepared by a variety of free radical-initiated polymerization reactions using, for example benzoyl peroxide or 2,2'-azobis(2-methylbutyronitrile).

A second class of stainblocking polymers useful in the invention are polymers of at least one or more (α- and/or β-substituted) acrylic acid monomers, these materials sometimes being referred to herein as (α- and/or β-substituted) acrylic acid polymers. The use of the parenthetical expression "alpha-and/or beta-substituted" indicates that substitution of the α- and β-positions of the acrylic acid monomer is independently optional. That is, both positions may be substituted, neither position may be substituted, or either one of the two positions may be substituted without the other-position being substituted. Thus, (α- and/or β-substituted) acrylic acid monomers that are useful in preparing the polymers have the general structure $HR^1C{=}C(R)COOX$, wherein R and $R^1$ are independently selected (i.e., they may be the same or they may be different) from hydrogen, organic radicals or halogen, and X is hydrogen, an organic radical, or a cation. Organic radicals that may be used to provide R and $R^1$ include aliphatic hydrocarbons (more preferably, alkyl moieties having 1 to 20, most preferably 1 to 4 carbon atoms such as methyl, ethyl, propyl and butyl), which, optionally, may be sulfonated or halogenated (for example, by chlorine or fluorine); and aromatic hydrocarbons (more preferably, a phenyl group), which, optionally, may be sulfonated, halogenated (for example, by chlorine or fluorine), hydroxylated (e.g., phenol or naphthol), or combinations thereof (e.g., sulfonated phenol or sulfonated naphthol). Halogens that may be used for R and $R^1$ include chlorine and fluorine.

Organic radicals that may be used to provide the X group include both aliphatic moieties (which may be linear, branched or cyclic, and preferably containing 1 to 10 carbon atoms), or aromatic moieties, any of which may, optionally, be halogenated, sulfonated, carboxylated, hydroxylated or ethoxylated, including cationic (e.g., sodium, potassium, ammonium, and quaternary amine) salts of these materials. Cations that may be used to provide X include sodium, potassium, ammonium, and quaternary amine.

Preferred monomers are defined by structures in which $R^1$ is hydrogen, R is an alkyl group having 1 to 4 carbon atoms, phenyl, phenol, sulfonated phenol, naphthol, chlorine, or fluorine, and X is hydrogen, an alkyl group of 1 to 10 carbon atoms, sodium, potassium or ammonium. The most preferred monomer is methacrylic acid ($R^1$ and X are hydrogen, R is methyl).

The (α- and/or β-substituted) acrylic acid polymers are preferably sufficiently water-soluble or water dispersible that uniform application and penetration of the polymer into the substrate surface can be achieved at normal application temperatures (room temperature to 100° C.). However, excessive water solubility may reduce the treated substrate's resistance to staining by acid colorants, as well as the effectiveness of the stainblocking compositions after cleaning the substrate.

The glass transition temperature of the (α- and/or α-substituted) acrylic acid polymers can be as low as 35° C. although higher glass transition temperatures are preferred. When polymers having high glass transition temperatures (e.g., 90° C. or higher) are used, an additional benefit of improved soil resistance may be obtained.

The weight average molecular weight and the number average molecular weight of the (α- and/or β-substituted) acrylic acid polymers should be selected so as to provide satisfactory stain resistance, water solubility, viscosity, and ability to be handled in conventional stainblocking polymer manufacturing and application processes. Preferably, the lower 90 weight percent of the polymer has a weight average molecular weight of 3,000 to 250,000, and a number average molecular weight of 500 to 50,000, more preferably 800 to 10,000. Generally, a larger proportion of water-soluble co-monomer is preferred for high molecular weight polymers and a larger proportion of water-insoluble co-monomer is preferred for low molecular weight polymers.

In some instances, however, higher molecular weight materials may be useful. For example, a water soluble copolymer of acrylic acid and methacrylic acid may have a weight average molecular weight of 80,000 to 500,000, more preferably 100,000 to 350,000, and most preferably 130,000 to 200,000. In the higher weight average molecular weight copolymers, the acrylic acid preferably comprises 1 to 20 weight percent, more preferably 5 to 15 weight percent, while the methacrylic acid correspondingly provides 99 to 80 weight percent, more preferably, 95 to 85 weight percent, the sum of the acrylic acid and methacrylic acid equaling 100 weight percent.

Included within the class of (α- and/or α-substituted) acrylic acid polymers are acrylic polymers; i.e., polyacrylic acid, copolymers of acrylic acid and one or more other monomers that are copolymerizable with acrylic acid, and blends of polyacrylic acid and one or more acrylic acid copolymers. These can be produced using well-known techniques for polymerizing ethylenically unsaturated monomers. Also included within the class of (α- and/or β-substituted) acrylic acid polymers, and most preferred, are methacrylic polymers; i.e., polymethacrylic acid, copolymers of methacrylic acid and one or more other monomers that are copolymerizable with methacrylic acid, and blends of polymethacrylic acid and one or more methacrylic acid copolymers. The methacrylic polymers useful in the invention can also be prepared using methods well-known in the art for polymerization of ethylenically unsaturated monomers.

Monomers useful for copolymerization with either the acrylic acid or the methacrylic acid have ethylenic unsaturation. Such monomers include monocarboxylic acids, polycarboxylic acids, and anhydrides of the mono- and polycarboxylic acids; substituted and unsubstituted esters and amides of carboxylic acids and anhydrides; nitriles; vinyl monomers; vinylidene monomers; monoolefinic and polyolefinic monomers; and heterocyclic monomers. Specific representative monomers include acrylic acid, itaconic acid, citraconic acid, aconitic acid, maleic acid, maleic anhydride, fumaric acid, crotonic acid, cinnamic acid, oleic acid, palmitic acid, vinyl sulfonic acid, vinyl phosphonic acid, and substituted or unsubstituted alkyl and cycloalkyl esters of these acids, the alkyl or cycloalkyl groups having 1 to 18 carbon atoms such as methyl, ethyl, butyl, 2-ethylhexyl, octadecyl, 2-sulfoethyl, acetoxyethyl, cyanoethyl, hydroxyethyl, b-carboxyethyl and hydroxypropyl groups. Also included are amides of the foregoing acids, such as acrylamide, methacrylamide, methylolacrylamide, 1,1-dimethylsulfoethylacrylamide, acrylonitrile, and methacrylonitrile. Various substituted and unsubstituted aromatic and aliphatic vinyl monomers may also be used; for example, styrene, a-methylstyrene, p-hydroxystyrene, chlorostyrene, sulfostyrene, vinyl alcohol, N-vinyl pyrrolidone, vinyl acetate, vinyl chloride, vinyl ethers, vinyl sulfides, vinyl toluene, butadiene, isoprene, chloroprene, ethylene, isobutylene, and vinylidene chloride. Also useful are various sulfated natural oils such as sulfated castor oil, sulfated sperm oil, sulfated soybean oil, and sulfonated dehydrated castor oil. Particularly useful monomers include ethyl acrylate, butyl acrylate, itaconic acid, styrene, sodium sulfostyrene, and sulfated castor oil, either alone or in combination. The methacrylic polymers may be polymerized in the presence of chain transfer agents or other polymers which may incorporate into the methacrylic polymer during polymerization.

In the methacrylic polymers, the methacrylic acid preferably provides 20 to 100 weight percent, more preferably 60 to 90 weight percent, of the polymer. The optimum proportion of methacrylic acid in the polymer depends on the comonomer(s) used, the molecular weight of the copolymer, and the pH at which the material is applied. When water-insoluble comonomers such as ethyl acrylate are copolymerized with methacrylic acid, they may comprise up to 40 weight percent of the methacrylic polymer. When water-soluble comonomers such as acrylic acid or sulfoethyl acrylate are copolymerized with methacrylic acid, the water soluble comonomers preferably comprise no more than 30 weight percent of the methacrylic polymer and preferably the methacrylic polymer also comprises up to 50 weight percent water-insoluble monomer.

Commercially available acrylic polymers useful as stainblocking polymers include Acrysol™ (available from Rohm and Haas Company) and Carbopol™ from B. F. Goodrich. Commercially available methacrylic polymers generally useful in the present invention include the Leukotan™ family of materials such as Leukotan™ 970, Leukotan™ 1027, Leukotan™ 1028, and Leukotan™ QR 1083, available from Rohm and Haas Company.

Polymers of (α- and/or β-substituted) acrylic acid monomers useful in the stainblocking compositions of the invention are described in U.S. Pat. No. 4,937,123 (Chang et al.), U.S. Pat. No. 5,074,883 (Wang), and U.S. Pat. No. 5,212,272 (Sargent et al.).

A third class of stainblocking polymers useful in the invention are hydrolyzed polymers of maleic anhydride and at least one or more ethylenically unsaturated monomers. The unsaturated monomer may be an alpha-olefin monomer or an aromatic monomer, although the latter is preferred. A variety of linear and branched chain alpha-olefins may be used including alkyl vinyl ethers. Particularly useful alpha-olefins are 1-alkenes containing 4 to 12 carbon atoms, such as isobutylene, 1-butene, 1-hexene, 1-octene, 1-decene, and 1-dodecene, with isobutylene and 1-octene being preferred, and with 1-octene being most preferred. A portion of the alpha-olefins can be replaced by one or more other monomers, e.g., up to 50 wt. % of alkyl (C1-4) acrylates, alkyl ($C_1$-4) methacrylates, vinyl sulfides, N-vinyl pyrrolidone, acrylonitrile, acrylamide, as well as mixture of the same.

A variety of ethylenically unsaturated aromatic monomers may be used to prepare the hydrolyzed polymers. The ethylenically unsaturated aromatic monomers may be represented by the general formula:

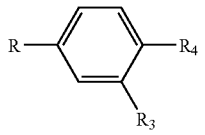

wherein R is $R^1$—CH═C($R^2$)— or $CH_2$═CH—$CH_2$—; $R^1$ is H—, $CH_3$— or phenyl $R^2$ is H— or $CH_3$—; $R^3$ is H— or $CH_3O$—; $R^4$ is H—, $CH_3$—, or acetyl and $R^3$ plus $R^4$ is —$CH_2$—O—$CH_2$—O—$CH_2$—.

Specific examples of ethylenically unsaturated aromatic monomers include free radically polymerizable materials such as styrene, α-methylstyrene, 4-methyl styrene, stilbene, 4-acetoxystilbene (used to prepare a hydrolyzed polymer from maleic anhydride and 4-hydroxy-stilbene), eugenol, isoeugenol, 4-allylphenol, safrole, mixtures of these materials, and the like. Styrene is most preferred. The utility of some of these materials may be improved by increasing the amount of polymerization initiator or acylating or etherifying the phenolic hydroxy groups.

In the hydrolyzed polymers, the ratio of units derived from ethylenically unsaturated monomer to units derived from maleic anhydride is 0.4:1 to 1.3:1 when the unsaturated monomer is an alpha-olefin, and is 1:1 to 2:1 when using an unsaturated aromatic monomer. In any event, a ratio of 1:1 is most preferred.

Hydrolyzed polymers suitable for use in the invention may be prepared by hydrolyzing ethylenically unsaturated maleic anhydride polymers. Alkali metal hydroxides (such as potassium hydroxide, lithium hydroxide and, most often, sodium hydroxide, as well as blends of these) are suitable hydrolyzing agents. Hydrolysis can be effected in the presence of more than or less than a molar amount of the alkali metal hydroxide. The presence of an alcohol in the hydrolysis mixture should be avoided.

Hydrolyzed polymers of at least one or more alpha-olefin monomers and maleic anhydride useful in the stainblocking compositions of the invention are described in U.S. Pat. No. 5,460,887 (Pechhold). Hydrolyzed polymers of at least one or more ethylenically unsaturated aromatic monomers and maleic anhydride useful in the stainblocking compositions of the invention are described in U.S. Pat. No. 5,001,004 (Fitzgerald et al.).

Useful stainblocking polymers may be obtained: (1) by blending together at least two or more polymers selected from among the different general classes of polymers described above; (2) by reacting together at least two or more monomers from which the different general classes of polymers are derived; (3) as the reaction product of at least one or more of the monomers from which the polymers may be derived and at least one or more of the polymers; or (4) by polymerizing at least one or more of the monomers in the presence of one or more of the polymers.

For example, one or more (α- and/or β-substituted) acrylic acid monomers may be polymerized together and, subsequent to the polymerization, blended with a sulfonated aromatic polymer. This permits both the carboxyl functionality from the (α- and/or β-substituted) acrylic acid polymer and the sulfonate functionality from the sulfonated aromatic polymer to contribute to the stainblocking properties of the composition. Particularly useful examples of such blends comprise a sulfonated aromatic condensation polymer (e.g., the condensation polymerization product of an aldehyde such as formaldehyde or acetaldehyde, a hydroxyaromatic compound such as bis(hydroxyphenyl)sulfone, phenol or napthol, and phenylsulfonic acid), and methacrylic polymer (e.g., polymethacrylic acid or a copolymer of methacrylic acid and or more of the following monomers: ethyl acrylate, butyl acrylate, itaconic acid, styrene, sodium sulfostyrene, sulfated castor oil, and acrylic acid).

The amounts of the sulfonated aromatic polymer and the (α- and/or β-substituted) acrylic acid polymer used should be sufficient to provide the desired degree of stain resistance to the substrate. Generally, when the substrate is nylon 6,6, lower application levels can be used than when the substrate is nylon 6 or wool. When the substrate is yarn heat-set under moist conditions (e.g., in an autoclave), generally higher application levels are required than when the yarn is heat-set under substantially dry conditions. Preferably, the amount of sulfonated aromatic polymer is at least 0.1% SOF, more preferably at least 0.2% SOF, most preferably at least 0.4% SOF when treating nylon 6,6 carpet fiber. Generally, amounts of sulfonated aromatic polymer in excess of 2% SOF provide little added benefit. Preferably the amount of (α- and/or β-substituted) acrylic acid polymer is at least 0.1% SOF, more preferably at least 0.2% SOF, most preferably at least 0.4% SOF when treating nylon 6,6 carpet fiber. Generally amounts of (α- and/or β-substituted) acrylic acid polymer in excess of 2% SOF provide little added benefit. Preferably, the amount of sulfonated aromatic polymer used is at least 0.2% SOF, more preferably at least 0.4% SOF, based on the weight of the fiber when treating nylon 6 carpet fiber. Preferably, the amount of (α- and/or β-substituted) acrylic acid polymer is at least 0.2 more, % SOF, preferably at least 0.4% SOF when treating nylon 6 carpet fiber.

Alternatively, the (α- and/or β-substituted) acrylic acid monomer may be polymerized in the presence of the sulfonated aromatic polymer. Examples of such compositions comprise an α—substituted acrylic acid monomer (e.g., having the structure $H_2C{=}C(R)CO_2H$, wherein R is an alkyl group having 1 to 4 carbon atoms, phenyl, phenol, sulfonated phenol, naphthol, chlorine or fluorine) polymerized in the presence of a sulfonated aromatic condensation polymer (e.g., the condensation polymerization product of an aldehyde such as formaldehyde or acetaldehyde, a hydroxy aromatic compound such as bis(hydroxyphenyl) sulfone, phenol or napthol, and phenylsulfonic acid). Such techniques are described in U.S. Pat. No. 4,940,757 (Moss, III et al.).

A free radical polymerization initiator is added to initiate polymerization of the (α- and/or β-substituted) acrylic acid monomer in the presence of the sulfonated aromatic polymer. Useful initiators include persulfates (e.g., potassium persulfate, ammonium persulfate, or sodium persulfate), peroxides (e.g., sodium peroxide, hydrogen peroxide, benzoyl peroxide, acetyl peroxide, lauryl peroxide, cumyl peroxide, t-butyl peroxide, or t-butyl hydroperoxide), azo compounds (e.g., azo-bis-isobutryonitrile), and hydrochloride salts of azo compounds.

In another embodiment, a stainblocking polymer may be prepared by reacting a sulfonated hydroxy aromatic compound with isocyanate, carboxylic acid, carboxylic acid anhydride, carboxylic acid chloride, or other carboxylic acid precursor, any of which may be saturated or unsaturated. The ester formed by this reaction may then be reacted by itself or with an (α- and/or β-substituted) acrylic acid, and a free radical polymerization initiator, either in the presence of or in the absence of another sulfonated aromatic polymer. Alternatively, the ester formed from the first reaction may be homopolymerized or copolymerized with an aromatic compound in an aldehyde condensation reaction. The resulting product can be further reacted, either by itself or with an (α- and/or β-substituted) acrylic acid in the presence of a free radical polymerization initiator. Useful free-radical polymerization initiators include persulfates (e.g., ammonium persulfate, sodium persulfate, or potassium persulfate), peroxides (e.g., sodium peroxide, hydrogen peroxide, benzoyl peroxide, acetyl peroxide, lauryl peroxide, cumyl peroxide, t-butyl peroxide, or t-butyl hydroperoxide), an azo compound (e.g., azo-bis-isobutyronitrile), and peracetate (e.g., t-butyl peracetate). Such techniques are described in U.S. Pat. No. 5,310,828 (Williams et al.).

Other useful combinations include hydrolyzed polymers of ethylenically unsaturated monomer and maleic anhydride blended with sulfonated aromatic polymers and/or polymers of (α- and/or β-substituted) acrylic acid. For example, a part of the maleic anhydride (up to 30 weight %) can be replaced by acrylic or methacrylic acid. In another embodiment, a part (preferably 1-75% by weight) of the maleic anhydride can be replaced by maleimide, N-alkyl ($C_{1-4}$) maleimides, N-phenyl-maleimide, fumaric acid, itaconic acid, citraconic acid, aconitic acid, crotonic acid, cinnamic acid, alkyl ($C_1$-18) esters of the foregoing acids, cycloalkyl ($C_2$-8) esters of the foregoing acids, sulfated castor oil, or the like.

Particularly preferred blends comprise 95 to 30 weight % of hydrolyzed polymer of ethylenically unsaturated aromatic monomer and maleic anhydride (more preferably, 85 to 40 weight %), and 5 to 70 weight % of a sulfonated aromatic condensation polymer, e.g., a sulfonated phenol-formaldehyde condensation polymer (more preferably, 15 to 60 weight %), wherein the sum of these two components is 100 weight %. Such combinations are described in U.S. Pat. No. 4,833,839 (Fitzgerald et al.).

The composition may optionally contain a sequestering agent to chelate hardness ions or redox active metal ions such as calcium, magnesium, iron, copper, manganese and the like that might be present in an aqueous use dilution water and detract from the cleaning performance of the composition as well the stability of the peroxide. The sequestering agent can be organic or inorganic. Organic sequestering agents include a broad range of materials that can complex hardness ions. These include EDTA and its salts, citric acid and its salts, boric acid and its salts, nitrilotriacetic acid and its salts, polyelectrolytes such as polyacrylic acid and its copolymers, polymaleic acid and its copolymers, and so on. Inorganic sequestering agents include condensed phosphates, particularly those of the formula $M\text{-}(PO_3M)_nOM$ wherein M is an alkali metal, n is a number ranging from 1 to 60, typically less than 3 for non-cyclic phosphates. Examples of such phosphates include alkali metal orthophosphates such as sodium or potassium orthophosphate and alkali metal condensed phosphates (i.e., polyphosphates) such as sodium or potassium pyrophosphate, sodium tripolyphosphate, sodium hexametaphosphate and the like. A preferred sequestering agent is sodium tripolyphosphate, due to its sequestration and soil suspension properties. The sequestering agent can generally be present in the concentrate formulation in an amount in the range from 2% to 12% by weight of a concentrate composition, preferably from 3% to 9% by weight and more preferably from 5% to 7% by weight. The sequestering agent can typically be present in an aqueous use dilution in an amount in the range from 0.05% to 0.25% by weight.

The composition may optionally contain salts for improving the deposition of the stainblocking polymer onto the fibrous substrates. Useful salts include metal salts and ammonium salts. Suitable salts for use in the present invention include divalent metal salts such as $MgSO_4$, $MgCl_2$, $CaCl_2$, $Ca(CH_3COO)_2$, $SrCl_2$, $BaCl_2$, $ZnCl_2$, $ZnSO_4$, $FeSO_4$ and $CuSO_4$; monovalent metal salts such as LiCl, NaCl, NaBr, NaI, KCl, CsCl, $Li_2SO_4$ and $Na_2SO_4$; polyvalent metal salts such as $AlCl_3$ and aluminum citrate; and ammonium salts such as $NH_4Cl$, $(NH_4)_2SO_4$, and $(CH_3)_4NCl$. Divalent metal salts are generally preferred, with magnesium salts (e.g., $MgSO_4$) being especially preferred, although good results can also be obtained under certain conditions through the use of monovalent metal salts or polyvalent metal salts or ammonium salts. The salt is most effective when applied at levels of 0.1 to 3%, preferably 0.5 to 3%, solids on fibrous substrates in the cleaning and treating composition.

The composition may optionally contain base and/or buffer to adjust the pH of the composition to its optimal working range of 4 to 7. When the pH of the composition is above 8, the stainblocking performance continually diminishes with increasing pH.

Typically when formulating the compositions of this invention, an upward pH adjustment to near neutrality is required due to the high inherent acidity of most stainblocking polymers. To make this upward pH adjustment, small amounts of strong bases such as sodium or ammonium hydroxide can be used. However, to better control the pH of the composition over an extended period of time, incorporation of larger amounts of a buffer can be employed. (For further information on buffers, see CRC Handbook of Chemistry and Physics, 2000-2001, 81$^{st}$ Ed., Ed. D. R. Lide, pp. 8-35 to 8-40.)

One suitable class of buffers are hydroxycarboxylic acid buffers including those described in Applicants' Assignee's copending U.S. Published Patent Application No. 2003-0194447 entitled ANTISEPTIC COMPOSITIONS AND METHODS, incorporated herein by reference.

The hydroxycarboxylic acid buffers preferably include beta- and alpha-hydroxy acids (BHAs, AHAs, respectively, collectively referred to as hydroxy acids (HAs)), their salts, lactones, and/or derivatives thereof. These may include mono-, di-, and tri-functional carboxylic acids. Particularly preferred are HAs having 1 or 2 hydroxyl groups and 1 or 2 carboxylic acid groups. Suitable HAs include but are not limited to, lactic acid, malic acid, citric acid, 2-hydroxybutanoic acid, 3-hydroxybutanoic acid, mandelic acid, gluconic acid, tartaric acid, salicylic acid, as well as derivatives thereof (e.g., compounds substituted with hydroxyls, phenyl groups, hydroxyphenyl groups, alkyl groups, halogens, as well as combinations thereof)). Preferred HAs include lactic acid, malic acid, and citric acid. These acids may be in D, L, or DL form and may be present as free acids, lactones, or salts thereof. Other suitable HAs are described in U.S. Pat. No. 5,665,776 (Yu).

Although in many embodiments the composition contains no organic solvent, it may be desirable that a small amount of a organic solvent be contained in the composition, e.g., because it has been included as part of the commercially available ingredients used (e.g., as a solvent or remnant of production), or in order to dissolve one or more other ingredients within the composition, or to facilitate wetting of the composition on the substrate. Generally the amount will be 1 to 30, preferably 3 to 20 most preferable 5 to 15 weight percent solvent.

Water soluble solvents are preferred "Water soluble" means that the organic solvent has a water solubility from about 1 weight percent, preferably ranging from about 10 weight percent. Further, the water-soluble organic solvent contains a moiety selected from the group of an alcohol, an aldehyde, a ketone, an ether, a glycol ether, an acid, an amine, an ester, an N-alkyl pyrrolidone, and a compatible mixture thereof. Typical solvents for the precursor fluorochemical amine are water miscible and include dimethyl formamide, dimethyl acetamide and N-methylpyrrolidone, ketones such as acetone or methyl ethyl ketone, ethers such as tetrahydrofuran, and alkoxy ethanols, such as 2-ethoxy ethanol or 2-butoxy ethanol (e.g. "Butyl Cellosolve").

The composition may optionally contain other ingredients, such as anti-foaming agents, fragrances, preservatives, and the like. If used, these added ingredients are typically present in relatively small amounts, such as 0.05% to 0.20% by weight of the composition in concentrate form, or from 0.008% to 0.031% by weight of the aqueous use dilution.

The composition may be prepared as a concentrate that contains a concentrated solution of the components described above, or as an "aqueous use dilution" wherein the above concentrate is combined with a sufficient amount of water to provide a solution that can be used by the consumer.

The compositions of the invention can be prepared by combining the ingredients, heated or unheated, with stirring until a uniform mixture is obtained. However, optimal peroxide levels are obtained when all ingredients are dissolved and the pH is optimal for peroxide stability, as disclosed earlier. Then the peroxide is charged at room temperature and allowed to mix thoroughly. The resultant solution is then packaged.

This compositions can be employed to clean carpets constructed from a variety of fibers, including polyamide (e.g., nylon 6 and nylon 6,6), wool, polyolefin (e.g., polypropylene), polyester, acrylic, and blends thereof. Preferably, the fiber is a polyamide or a polyamide blend fiber.

The compositions of the invention may applied from a container having any suitable dispenser, such as a dabbing, sprinkling, pouring, or spraying dispenser. For example, the composition may be sprayed upon the soiled surface or simply poured thereon in concentrated or "ready-to-use" form as desired. Spraying can be accomplished by conventional mechanical spraying devices (such as by use of a conventional trigger spray device) or by using an aerosol-dispensing container with a sufficient amount of suitable aerosol propellant such as an inert gas, low-boiling alkanes or mixtures thereof, such as a mixture isobutane and propane, carbon dioxide, hydrofluorocarbons, dimethyl ether, and other commonly used propellents.

Aerosol containers are not particularly amendable to peroxide-containing compositions, as the transition metal ions from the interior surface of the cans are known to catalyze decomposition of hydrogen peroxide, which increases the amount of gas in the aerosol can, potentially creating a safety hazard. This decomposition of peroxides is also observed at higher pH (greater than 7), which is usually required for reducing corrosion in the metal cans. This can be overcome by using aluminum cans, and even lined aluminum cans which can tolerate a lower pH of 4 to 7. This allows stable peroxide formulations to be charged and can have shelf lives of greater than 2 years without excessive pressure build up.

Performing a mechanical operation to the soiled surface after application of a composition of the invention may be desired or required for soil removal. Performing a mechanical operation may include wiping, abrading, scrubbing, brushing, and the like. After performing a mechanical operation on the surface, the composition is preferably removed. This can be accomplished by a variety of techniques that are generally known, including, for example, blotting, or rinsing the composition from the surface, or vacuum removal upon drying.

The present composition is also advantageously used in a wiping article, where a woven, knitted, nonwoven or sponge substrate is imbibed with the instant composition. Such wiping articles, whether single- or multiple use, are enjoyed by consumers for their convenience. Nonwoven webs are particularly useful as substrates because of their utility in the manufacture of cleaning and/or scouring articles.

The wiping article substrate may comprise any of a variety of natural or synthetic materials. A particularly useful substrate shape is a fiber made of natural and/or synthetic materials and articles made with such fibers. Suitable natural fibers include cotton, flax, hemp, ramie, rayon, burlap, shoddy cotton, cotton linters, and pulp fibers. Suitable synthetic fibers include viscose rayon, rayon and the like, polyolefin fibers such as polyester, polypropylene, and polyamide fibers, polyvinyl alcohol, nylon and acrylic fibers. Polymeric foams such as polyurethane foams can be used as the wiping substrate.

Known wipe materials generally have a basis weight in the range of from 15 to 300 grams/$m^2$, although materials having a higher basis weight could be used. Woven and knitted materials are suitable, as are non-woven materials including dry-laid, wet-laid and spun-bonded materials which may, as appropriate, be thermally-bonded, resin-bonded, ultrasonically-bonded, needle-punched, hydro-entangled etc. Wipes materials are often categorized, depending on their durability, as "disposable" (meaning that a wiping article formed from the material is intended to be discarded immediately after use), "semi-disposable" (meaning that a wiping article formed from the material can be washed and re-used a limited number of times), or "reusable" (meaning that a wiping article formed from the material is intended to be washed and re-used).

Disposable wipe materials suitable for use as the web material include spun-bond and spun-lace non-woven materials having a basis weight in the range of from 15 to 75 g/$m^2$ and formed, for example, from polyester, rayon, viscose, wood pulp, polyolefins such as polypropylene, natural fibers, polyamide or mixtures thereof. Examples of disposable wipe materials are available under the trade names: "Sontara" from DuPont; and "Tenolace" from Tenotex of Terno d'Isola, Italy.

Semi-disposable wipe materials suitable for use as the web material include spun-lace non-woven materials having a basis weight in the range of from 75 to 250 g/$m^2$ and formed, for example, from fibers or microfibers of polyester, polyamide, viscose. Examples of semi-disposable wipe materials are available under the trade names "Scotch-Brite™ Dusting Cloth" from 3M Company of St. Paul, Minn., USA; and "Sontara" from DuPont.

Reusable wipe materials suitable for use as the web material include knitted, woven, thermo-bonded, latex-coated, and chamois-type materials having a basis weight in the range of from 100 to 300 g/$m^2$ and formed, for example, from fibers or microfibers of polyester, rayon, viscose, polypropylene, natural fibers, polyamide or mixtures thereof. An example of a reusable wipe material is the material used for wipes available under the trade name "Cif" from Lever Fabergè, Switzerland.

The cleaning composition can be applied to a wiping article by any of a variety of known coating methods, as is known in the art. The desired amount of composition added to the wiping article depends upon the type and application for a particular substrate. Typically, the wet wipes will contain from about 100 to about 500 weight percent cleaning solution based on the dry weight percent of the nonwoven wipe material, preferably from about 300 to about 400 weight percent.

The composition can be applied to a wiping substrate by any of a variety of known coating methods, including spraying, knife coating, roll coating, spin coating, immersion coating, and the like. If desired, excess may be removed from the substrate. The coating method chosen for the manufacture of a particular article may depend on the nature and form of the wiping substrate as well as other factors known to those skilled in the art. It is generally desirable to have the composition deposited over the entire available surface of the substrate, but this is not essential. The desired amount of composition added to the wiping article depends upon the type and application for a particular substrate.

The invention is further described by reference to the following examples, which are understood to be illustrative and non-limiting of the invention. Unless otherwise specified, all percentages shown in the examples and test methods which follow are percentages by weight.

EXAMPLES

In the following table, a source is disclosed for where the chemicals used in the Examples can be obtained. However, it is understood that these chemicals or similar chemicals can be obtained from multiple sources.

| List of Chemical Components | |
|---|---|
| Water | Softened or Deionized |
| Hydrogen Peroxide | Cosmetic or Technical Grade (35% or 50%) (Brenntag Canada, Inc.) |
| Sodium Lauryl Sulfate (30%) | Stepanol WAC (Stepan Chemical Co.) |
| Disodium Lauramide Sulfosuccinate (45%) | Geropon SBL-203 (Rhodia) |
| Sodium-N-methyl-N-Oleoyl Taurate (67%) | Geropon T-77 (Rhodia) |
| PM 1870 | siloxan polymer (3M Company) |
| FC 672 | hydrocarbon polymer (3M Company) |
| 2-butoxy ethanol | ButylCellosolve (Brenntag Canada, Inc.) |
| Sodium Citrate (100%) | Sodium Citate (ADM Co.) |
| Citric Acid (100%) | Citric Acid (ADM Co.) |
| Flexisperse AM 130 | hydrocarbon polymer (ICT Co.) |
| Terrasol Mod 5 | siloxane polymer (Terrasol) |
| Sodium 2-ethyl-hexyl sulfate | Rhodapon BOS (Rhodia) |
| Polyoxyethylene Oleyl ether | Brij 35 (Uniqema) |
| Polyoxyethylene alkyl ether | Tergitol 15-S-30 (Dow Chemical Co) |

Example 1

Examples of the cleaning compositions are given in TABLE 1. These compositions are meant to be exemplary but not exhaustive as to the combinations of said components. The compositions are labeled C1 through C8. All weights are given as weight percents and are of chemicals as received.

It is known that the hydrogen peroxide will decompose when exposed to redox active impurities (nickel, manganese, iron, copper etc.) as well as high pH conditions and temperature. An aging study of several of the above formulations are reported in TABLE 2. The results show that the antisoiling additives and the stainblocking additives do not effect the peroxide concentrations over time. The optimal pH for the stainblockers to be most effective is 3 to 5.5, and the peroxide composition pH is 4.5 to 5 as described above. Alternative compositions without these additives have been reported elsewhere to be stable. The titration procedure to determine the hydrogen peroxide level is as follows.

Titration

At each time point in the study, a titration of the hydrogen peroxide was performed. Approximately 0.2 g samples (weighed to ±0.0001 g) were weighed into 100 mL disposable plastic beakers. 50 mL of 1 N $H_2SO_4$ was added to the beaker. The sample was titrated potentiometrically with 0.1 N Cerium Sulfate. The titration parameters were: Metrohm Titrino 751 titrator, monotonic titration with 20 μL dosing increments, endpoint evaluation criterion (derivative)=15. A predose of titrant proportional to sample size was added to each titration to minimize the total titration time by starting the monotonic titration approximately 1 mL from the endpoint.

The titrant was standardized each week against oven-dried sodium oxalate. The sodium oxalate was weighed to ±0.001 mg into glass beakers, and 60 mL of 1 N $H_2SO_4$ was added. The solution was heated with stirring to 90° C. The solution was immediately titrated, while hot, with the 0.1 N cerium sulfate. Triplicate titrations were performed for each standardization. If the normality of the titrant had changed by a greater increment than the standard deviation of the standardization procedure, the new normality was used in that week's calculations.

TABLE 1

| Chemicals | | C1 Wt % | C2 Wt % | C3 Wt % | C4 Wt % | C5 Wt % | C7 Wt % | C8 Wt % | C6 Wt % |
|---|---|---|---|---|---|---|---|---|---|
| Water | Diluent | 76.92 | 75.22 | 76.72 | 76.48 | 76.98 | 84.32 | 79.00 | 90.72 |
| Hydrogen Peroxide | Active Oxygen | 7.80 | 8.00 | 8.00 | 8.00 | 8.00 | 6.00 | 6.00 | — |
| Sodium Lauryl Sulfate (30%) | Surfactant | 1.00 | 1.00 | 1.00 | 1.00 | 1.00 | 1.00 | 1.00 | 1.00 |
| Disodium Lauramide Sulfosuccinate (45%) | Surfactant | 0.24 | 0.24 | 0.24 | — | — | 0.24 | — | 0.24 |
| Sodium-N-methyl-N-Oleoyl Taurate (67%) | Surfactant | 0.52 | 0.52 | 0.52 | — | — | 0.52 | — | 0.52 |
| PM 1870 | Soil Repellent | 3.50 | — | 3.50 | 3.50 | 3.50 | — | 3.50 | — |
| FC 672 | Stainblocker | 2.00 | 2.00 | — | 2.00 | 2.00 | — | 2.00 | — |
| Butyl Cellosolve | Solvent | 7.50 | 7.50 | 7.50 | 7.50 | 7.50 | 7.50 | 7.50 | 7.50 |
| Sodium Citrate (100%) | pH Buffer | 0.15 | 0.15 | 0.15 | 0.15 | 0.15 | 0.08 | — | — |
| Citric Acid (100%) | pH Buffer | 0.35 | 0.35 | 0.35 | 0.35 | 0.35 | 0.35 | — | — |
| Fragrance | | 0.02 | 0.02 | 0.02 | 0.02 | 0.02 | | — | 0.02 |
| Flexisperse AM 130 | Stainblocker | — | — | 2.00 | — | — | — | — | — |
| Terrasol Mod 5 | Soil Repellent | — | 5.00 | — | — | — | — | — | — |
| Sodium 2-ethyl-hexyl sulfate | Surfactant | — | — | — | 0.50 | — | — | 1.00 | — |
| Polyoxyethylene Oleyl ether | Surfactant | — | — | — | — | 0.5 | — | — | — |
| Polyoxyethylene alkyl ether | Surfactant | — | — | — | 0.50 | — | — | — | — |

TABLE 2

| day | C1 | C2 | C3 |
|---|---|---|---|
| 0 | 3.84 | 4.01 | 4.06 |
| 13 | 3.84 | 3.97 | 4.06 |
| 28 | 3.84 | 4.00 | 4.04 |
| 40 | 3.83 | 3.97 | 4.02 |
| 56 | 3.87 | 4.02 | 4.03 |
| 69 | 3.78 | 3.93 | 3.94 |
| 83 | 3.85 | 4.01 | 3.99 |
| 91 | 3.85 | 4.02 | 4.00 |

The stain removal performance is also not effected by the various stainblockers or antisoiling agents employed is these examples. The procedure for determined the efficacy of Carpet Stain Removal Test is as follows:

1. A 30 ounce face weight 7 year warranty nylon cut-pile carpet was used. A two inch diameter cylinder was placed on the carpet and 10 grams of staining material was evenly spread on top of the carpet.
2. The stain was allowed to set for 2 hours.
3. As much of the staining material was then removed with a paper towel or white cloth.
4. When no more could be removed, 10 g of cleaning solution deliver from a syringe was applied using the same 2 inch diameter cylinder.
5. The solution was allowed to sit for 2 to 3 minutes and then the stain was gentyl worked out with a paper towel or white cloth.
6. Blotting continued, until no more color could be removed.
7. The samples yarn piles were lifted either by hand or with a coarse comb and allowed to dry for 24 hours.
8. The samples were then read using a Minolta 310 Chroma Meter with a D65 illumination source, which is recorded as a ΔE value (ΔE=((the difference between the L*unstained and L*stained/cleaned)$^2$+(the difference between the a*unstained and a*stained/cleaned)$^2$+(the difference between the b*unstained and b*stained/cleaned)$^2$)$^{0.5}$, which measures the difference in color reading between a soiled and unsoiled carpet sample. This color measurement procedure for determining soiling of carpet is described in ASTM D-6540.

The average results of several stain removals were recorded in the Table 3. These results are somewhat dependent on the type of carpet, but are generally typical of what would be observed in most cases. All results are reported as Delta E.

TABLE 3

| | Grape Juice | Spaghetti Sauce | Beef Gravy | Red Clay | Red Wine | Potting Soil | Grape Jelly |
|---|---|---|---|---|---|---|---|
| C1 | <1 | 1.7 | 2.1 | <1 | <1 | <1 | <1 |
| C2 | <1 | 1.7 | 2.1 | <1 | <1 | <1 | <1 |
| C3 | <1 | 1.9 | 2.3 | <1 | <1 | <1 | <1 |
| C4 | <1 | 1.7 | 2.1 | <1 | <1 | <1 | <1 |
| C5 | <1 | 2.4 | 2.4 | <1 | <1 | <1 | <1 |
| C6 | 5.5 | 5.7 | 4.8 | 3.5 | 4.1 | 2.1 | 4.1 |

The soiling tests are conducted and measured as follows:

"Walk-On" Soiling Test—The relative soiling potential of each treatment was determined by challenging both treated and untreated (control) carpet samples under defined "walk-on" soiling test conditions and comparing their relative soiling levels. The test is conducted by mounting treated and untreated carpet squares on particle board, placing the samples on the floor of one of two chosen commercial locations, and allowing the samples to be soiled by normal foot traffic. The amount of foot traffic in each of these areas is monitored, and the position of each sample within a given location is changed daily using a pattern designed to minimize the effects of position and orientation upon soiling.

Following a specific soil challenge period, measured in number of cycles where one cycles equals approximately 10,000 foot-traffics, the treated samples are removed and the amount of soil present on a given sample is determined using colorometric measurements, making the assumption that the amount of soil on a given sample is directly proportional to the difference in color between the unsoiled sample and the corresponding sample after soiling. This color difference can be quantified using the three CIE L*a*b* color coordinates of a Minolta 310 Chroma Meter with a D65 illumination source, which is recorded as a ΔE value (ΔE=((the difference between the L*unstained and L*stained/cleaned)$^2$+(the difference between the a*unstained and a*stained/cleaned)$^2$+(the difference between the b*unstained and b*stained/cleaned)$^2$)$^{0.5}$, which measures the difference in color reading between a soiled and unsoiled carpet sample. This color measurement procedure for determining soiling of carpet is described in ASTM D-6540. The higher the ΔE, the more soiled a sample is. Such ΔE values have been shown to be qualitatively in agreement with values from older, visual evaluations such as the soiling evaluation suggested by the AATCC, and have the additional advantages of higher precision, being unaffected by evaluation environment or subjective operator differences. AE values recorded in the examples represent averages of between five and seven replicates.

The walk on testing was also compared to an unchallenged piece of carpet, which is labeled "New Carpet". It is well know by consumers that some products used to removed stains from carpet will attract soil, as discussed earlier. The levels of anti-soiling agents were determined to match within 1 Delta E of a typical carpet with a high level of mill applied anti-soiling protection—such as a 7 to 10 years soil resist warranty such as those associated with brands like Scotchgard™, StainMaster™, and Wear-Dated™.

TABLE 4

| Resoiling | Delta E |
|---|---|
| C1 | 5 |
| C2 | 5 |
| C3 | 5 |
| C4 | 4.5 |
| C5 | 5 |
| C6 | 22 |
| New Carpet | 6 |

Staining Test

Stain resistance of a carpet sample was determined as follows. First, a red staining solution was prepared by dissolving 0.007% of Red Dye FD&C #40 in deionized water, then adjusting the solution pH to 3.0 using 10% aqueous sulfamic acid. The staining solution was adjusted to 22° C., and 5 g of the solution was placed on the top side of a carpet sample inside the confines of a 4 cm diameter template for a period of 2 minutes. Excess staining solution was absorbed through the back side of the carpet sample using a cellulose sponge. The stain was allowed to air dry at 22° C. for 24 hours, then the carpet sample was rinsed using cool water with no agitation until the rinse water remained clear. The stained carpet sample was allowed to air dry at room temperature. The degree of staining of the carpet sample was determined numerically by using the three CIE L*a*b* color coordinates measured with a Minolta 310 Chroma Meter with a D65 illumination source.

The levels of stainblocking polymers were determined to match within 1 Delta E of a typical carpet with a high level of mill applied anti-soiling protection—such as a 7 to 10 years stain resistant warranty such as those associated with brands like Scotchgard™, Stainmaster™, Wear-Dated™ etc.

TABLE 5

| Restaining - FD&C #40 pH 3.0 | Delta E |
|---|---|
| C1 | <1 |
| C2 | <1 |
| C3 | <1 |
| C4 | <1 |
| C5 | <1 |
| C6 | >20 |
| Fresh Carpet | <1 |

Example 2

To demonstrate the usefulness of the cleaning solution in a wet wipe form, 30 dry nonwoven sheets were saturated with 200 grams of the cleaning solution using the formulation described in composition C-7. The nonwoven material used for the sheets was Hydraspun® Grade 10201, a hydroentangled blend of cellulosic fibers and synthetic polyethylene/polyester bicomponent fibers (available from Ahlstrom, Windsor Locks, Conn.). The individual nonwoven sheets measured 7 inches by 8 inches and had a basis weight of 48.5 grams per square meter. The sheets were in roll form in a canister (30 sheets per canister) typical of canisters presently used for commercially available wet wipes such as Clorox® Disinfecting Wipes. The total weight of the nonwoven sheets in the canister was 50 grams. The wipes were tested for carpet stain removal using the test method described above. Results are given in Table 6 and 7.

The wipes were evaluated with the previous Carpet Stain Removal Test, except step 4 was substituted by wiping for two minutes, allowing to dry for an hour at room temperature and repeating with four successive fresh wipes. At the end of the four successive wiping applications, the carpet was allowed to dry for 48 hours, then the delta E measured. The same samples were then tested using the Accelerated Soiling Test.

Accelerated Soiling Test: IWS Test Method No. 267/1991 "Test Method for Assessing the Soiling Propensity of Floorcoverings". The test is intended to assess the propensity of carpets to soiling using the artificial soil composition. The results were reported using delta E values Example 2

Wet wipes were prepared in a manner identical to Example 2, except that the cleaning solution formulation described in composition C-8 was used. The wipes were tested for carpet stain removal using the test method described above. For comparison, Woolite Oxy Deep™ spot and stain carpet cleaner (in liquid form) was also tested. Results are given in Tables 6 and 7.

TABLE 6

| Staining Material | Number of Applications of Carpet Stain Remover | Example 2 | Example 3 |
|---|---|---|---|
| Coffee | 1st Application | 4.61 | 4.46 |
| | 2nd Application | 3.46 | 4.20 |
| | 3rd Application | 4.62 | 4.18 |
| | 4th Application | 2.22 | 2.00 |
| | after 48 h dry | 2.47 | 2.86 |
| | after soiling | 13.71 | 11.19 |
| Kool-Aid | 1st Application | 0.42 | 0.81 |
| | 2nd Application | 0.32 | 0.51 |
| | 3rd Application | 0.55 | 0.74 |
| | 4th Application | 1.01 | 0.79 |
| | after 48 h dry | 1.05 | 0.98 |
| | after soiling | 12.39 | 9.23 |
| Red Wine | 1st Application | 1.01 | 1.34 |
| | 2nd Application | 0.93 | 1.14 |
| | 3rd Application | 0.72 | 0.78 |
| | 4th Application | 1.00 | 0.68 |
| | after 48 h dry | 1.23 | 0.97 |
| | after soiling | 11.50 | 9.20 |

Delta E of soiled vs. new carpet: 11.90

TABLE 7

| Staining Material | Number of Applications of Carpet Stain Remover | Example 2 | Example 3 |
|---|---|---|---|
| Ketchup | 1st Application | 2.84 | 3.76 |
| | 2nd Application | 1.29 | 1.93 |
| | 3rd Application | 1.48 | 1.39 |
| | 4th Application | 1.14 | 1.21 |
| | after 48 h dry | 0.81 | 2.24 |
| | after soiling | 13.19 | 9.95 |
| Mustard | 1st Application | 10.89 | 12.02 |
| | 2nd Application | 9.04 | 10.16 |
| | 3rd Application | 3.74 | 3.80 |
| | 4th Application | 3.23 | 2.41 |
| | after 48 h dry | 0.67 | 0.81 |
| | after soiling | 15.78 | 11.41 |
| Spaghetti Sauce | 1st Application | 2.75 | 4.19 |
| | 2nd Application | 1.41 | 1.24 |
| | 3rd Application | 1.75 | 1.70 |
| | 4th Application | 1.48 | 1.12 |
| | after 48 h dry | 1.28 | 1.25 |
| | after soiling | 15.98 | 11.75 |

Delta E of soiled vs. new carpet: 13.21

We claim:

1. An aqueous composition comprising a silsesquioxane, a surfactant, 1 to 8 weight percent of a peroxy compound, and a sequestering agent selected from the group consisting of EDTA and a salt thereof, citric acid and a salt thereof, boric acid and a salt thereof, nitrilotriacetic acid and a salt thereof, metal orthophosphates, an alkali tripolyphosphate, an alkali metal pyrophosphate, an alkali metal hexametaphosphate, and a mixture thereof, wherein said composition has a pH of 4 to 5.5.

2. The composition of claim 1 wherein said peroxy compound is selected from the group consisting of hydrogen peroxide, t-butyl peroxide, $R^3$—C(O)OO—H, where $R^3$=alkyl, aryl or benzyl), $R^4$—C(O)OOC(O)—$R^4$, wherein each $R^4$ is independently alkyl, aryl or benzyl, perborate or percarbonate salts.

3. The composition of claim 1 wherein said peroxy compound is cosmetic grade hydrogen peroxide.

4. The composition of claim 1, wherein the silsesquioxane comprises co-condensates of compounds of the formula R—Si$(OR')_3$ wherein R is a substituted or unsubstituted hydrocarbon radical having 1 to 7 carbon atoms, and R' is an alkyl radical with 1 to 4 carbon atoms.

5. The composition of claim 4, wherein the silsesquioxane comprises co-condensates of compounds of the formula $R—Si(OR')_3$ wherein R and R' are $—CH_3$.

6. The composition of claim 4, wherein the silsesquioxane comprises cocondensates of $R—Si(OR')_3$ and silanes selected from $Si(OR')_4$ and $R_2—Si(OR')_2$, or combinations thereof, wherein R is an unsubstituted hydrocarbon radical having 1 to 7 carbon atoms, and R' is an alkyl radical with 1 to 4 carbon atoms.

7. The composition of claim 1, wherein the surfactant comprises a nonionic, anionic or amphoteric surfactant.

8. The composition of claim 7, wherein the surfactant is anionic.

9. The composition of claim 8, wherein the anionic surfactant is sodium xylene sulfonate, sodium lauryl sulfate, sodium 2-ethylhexyl sulfate, sodium myristyl sulfate, sodium lauryl ether sulfate, sodium decyl sulfate, ammonium myristyl ether sulfate, sodium nonylphenol polyglycol ether sulfate, sodium $C_{16}$-$C_{18}$ α-olefin sulfonate, sodium dodecylbenzenesulfonate, sodium naphthyl sulfonate, sodium dihexyl sulfosuccinate, sodium laurate, sodium stearate, sodium ether stearate, potassium ricinoleate, sodium myristoyl sarcosine, sodium N-methyl-N-oleyl taurate, or combinations thereof.

10. The composition of claim 7, wherein the surfactant is a nonionic surfactant having an HLB value of at least 18.

11. The composition of claim 10, wherein the nonionic surfactant is nonylphenol polyethylene glycol ether.

12. The composition of claim 7 wherein the surfactant comprises a combination of anionic and nonionic surfactants.

13. The composition of claim 7, wherein the surfactant is sodium xylene sulfonate, sodium lauryl sulfate, sodium 2-ethylhexyl sulfate, sodium myristyl sulfate, sodium lauryl ether (2) sulfate, sodium decyl sulfate, ammonium myristyl ether sulfate, sodium nonylphenol polyglycol ether sulfate, sodium $C_{16}$-$C_{18}$ α-olefin sulfonate, sodium dodecylbenzenesulfonate, sodium naphthyl sulfonate, sodium dihexyl sulfosuccinate, sodium laurate, sodium stearate, sodium ether stearate, potassium ricinoleate, sodium myristoyl sarcosine, sodium N-methyl-N-oleyl taurate, nonylphenol polyethylene glycol ether or combinations thereof.

14. The composition of claim 13, wherein the surfactant comprises sodium xylene sulfonate and nonylphenol polyethylene glycol ether.

15. The composition of claim 1 further comprising a stainblocker.

16. The composition of claim 1, wherein the stainblocker comprises a polymer derived from at least one or more alpha- and/or beta-substituted acrylic acid monomers.

17. The composition of claim 16, wherein the alpha- and/or beta-substituted acrylic acid monomers are polymethacrylic acid, copolymers of methacrylic acid and one or more other monomers that are copolymerizable with methacrylic acid, and blends of polymethacrylic acid and methacrylic acid copolymer.

18. The composition of claim 17, wherein the polymer comprises a copolymer of methacrylic acid and butyl acrylate.

19. The composition of claim 16, wherein said stainblocker comprises a polymer derived from polymethacrylic acid, copolymers of methacrylic acid and one or more other monomers that are copolymerizable with methacrylic acid, and blends of polymethacrylic acid and methacrylic acid copolymer;

said silsesquioxane comprises compounds of the formula $R—Si(OR')_3$ wherein R is a substituted or unsubstituted hydrocarbon radical having 1 to 7 carbon atoms, and R' is an alkyl radical with 1 to 4 carbon atoms;

said surfactant is sodium xylene sulfonate, sodium lauryl sulfate, sodium myristyl sulfate, sodium lauryl ether sulfate, sodium decyl sulfate, ammonium myristyl ether sulfate, sodium nonylphenol polyglycol ether sulfate, sodium $C_{16}$-$C_{18}$ α-olefin sulfonate, sodium dodecylbenzenesulfonate, sodium naphthyl sulfonate, sodium dihexyl sulfosuccinate, sodium laurate, sodium stearate, sodium ether stearate, potassium ricinoleate, sodium myristoyl sarcosine, sodium N-methyl-N-oleyl taurate, nonylphenol polyethylene glycol ether or combinations thereof and said pH is from 4 to 7.

20. The composition of claim 1, wherein the composition comprises:

a) 0.25 to 5 weight percent silsesquioxane;

b) 1 to 8 weight percent peroxy compound;

c) 0.25 to 10 weight percent surfactant.

21. The composition of claim 1 wherein said composition comprises a) 0.5 to 2 weight percent silsesquioxane;

b) 2 to 4 weight percent peroxy compound, and c) 0.5 to 4 weight percent surfactant.

22. The composition of claim 1, wherein said sequestering agent comprises sodium tripolyphosphate.

23. The composition of claim 15, further comprising 0.5 to 2 weight percent stainblocker.

24. A method of cleaning a fibrous substrate comprising the steps of:

a) contact the substrate with the composition of claim 1, and b) at least partial removal of the composition from the substrate.

25. The method of claim 24, wherein the substrate is carpet.

26. The method of claim 25, wherein the substrate comprises nylon carpet.

27. An applicator for applying a cleaning composition to a substrate comprising a container, said applicator comprising a dispenser and the composition of claim 1.

28. The applicator of claim 27 wherein said applicator is a manually pumped spray container.

29. The applicator of claim 27 wherein the applicator is a pressurized spray container.

30. The applicator of claim 27 wherein said dispenser is a dabbing, sprinkling, pouring, or spraying dispenser.

31. A wiping article comprising a woven, nonwoven or sponge substrate imbibed with the composition of claim 1.

32. The wiping article of claim 31 wherein said article comprises a nonwoven substrate.

33. The wiping article of claim 31 comprising 100 to about 500 weight percent of the composition of claim 1, relevant to the weight of the substrate.

* * * * *

UNITED STATES PATENT AND TRADEMARK OFFICE

CERTIFICATE OF CORRECTION

PATENT NO. : 7,320,956 B2
APPLICATION NO. : 10/815277
DATED : January 22, 2008
INVENTOR(S) : Mitchell T. Johnson It is certified that error appears in the above-identified patent and that said Letters Patent is hereby corrected as shown below:

Column 7,
Line 39, delete "mulfivalent," and insert -- multivalent, --, therefor.

Column 8,
Line 32, delete "C," and insert -- $C_1$ --, therefor.

Column 10,
Line 22, delete "PC48;" and insert -- PC-48; --, therefor.

Column 16,
Line 54, after "and/or" delete "α-" and insert -- β- --, therefor.

Column 17,
Line 18, after "and/or" delete "α-" and insert -- β- --, therefor.

Column 22,
Line 56, delete "N-methylpyrrolidone," and insert -- N-methyl pyrrolidone, --, therefor.

Column 32,
Line 18, in claim 19, after "thereof" insert -- ; --.

Signed and Sealed this

Second Day of December, 2008

JON W. DUDAS
*Director of the United States Patent and Trademark Office*